US005580264A

United States Patent [19]

Aoyama et al.

[11] Patent Number: 5,580,264

[45] Date of Patent: Dec. 3, 1996

[54] WATERPROOFED CONNECTOR

[75] Inventors: Masahiko Aoyama; Hirotaka Makino, both of Yokkaichi, Japan

[73] Assignee: Sumitomo Wiring Systems, Ltd., Japan

[21] Appl. No.: 507,927

[22] Filed: Jul. 27, 1995

[30] Foreign Application Priority Data

| | | | |
|---|---|---|---|
| Aug. 9, 1994 | [JP] | Japan | 6-209234 |
| Aug. 18, 1994 | [JP] | Japan | 6-217973 |
| Aug. 18, 1994 | [JP] | Japan | 6-217974 |

[51] Int. Cl.[6] ..... H01R 13/52

[52] U.S. Cl. ..... 439/275; 439/587; 439/604

[58] Field of Search ..... 439/271–275, 439/278, 279, 586–589, 597–600, 604, 606, 445, 447

[56] References Cited

U.S. PATENT DOCUMENTS

| | | | |
|---|---|---|---|
| 4,312,553 | 1/1982 | Lyckejö | 439/606 |
| 5,114,359 | 5/1992 | Chishima et al. | 439/271 |
| 5,222,909 | 6/1993 | Nomura et al. | 439/271 |
| 5,295,865 | 3/1994 | Endo et al. | 439/271 |
| 5,472,352 | 12/1995 | Nishida et al. | 439/274 |
| 5,474,465 | 12/1995 | Kobayashi | 439/272 |

FOREIGN PATENT DOCUMENTS

| | | | |
|---|---|---|---|
| 597388A2 | 5/1994 | European Pat. Off. | 439/271 |

*Primary Examiner*—Neil Abrams
*Assistant Examiner*—Brian J. Biggi
*Attorney, Agent, or Firm*—Jordan B. Bierman; Bierman and Muserlian

[57] ABSTRACT

A waterproofed connector has an outlet for an electrical cable which is molded by a resin material under a structure which can prevent a mold resin material from entering into terminal metal fixtures. The waterproofed connector includes a connector housing (10) having a cavity (12), terminal metal fixtures (40) each connected to an end of each core wire (22) of an electrical cable (20) and inserted into a terminal opening (131) in the cavity (12), a plug body (50) inserted into the cavity (12) and having a pair of through holes (53) for permitting each core wire (22) to pass through and a mold resin layer (100) formed around a rear end of the connector housing (10). The plug body (50) made of a resilient material contacts firmly with an interior of the opening (131), so that the plug body (50) can prevent the mold resin material from entering into the terminal metal fixtures when molding and also can perform waterproofing even if any clearance is formed between the mold resin layer (100) and the electrical cables (22). The plug body (50) and an accommodating chamber in the cavity (12) may be provided with tapered exterior and interior, respectively, thereby causing a close contact between the plug body (50) and the connector housing (10) by an injection pressure of a mold resin material. The plug body and accommodating chamber may not be provided with the tapered exterior and interior. A waterproofing seal (30) may be mounted on each terminal metal fixture (40) through the opening (131) in the cavity (12) so that the seal (30) makes close contact with the interior of the cavity (12). Even if any clearance may be formed between the mold resin layer (100) and the electrical cables (22) or the connector housing (10), the water which enters into the cavity (12) through the clearance is prevented from further advancing in the cavity by the waterproofing seal (30).

18 Claims, 37 Drawing Sheets

WATERPROOFED CONNECTOR

BACKGROUND OF THE INVENTION (1) Field of the Invention

This invention relates to a waterproofed connector in which a cable outlet of a connector housing is coupled to a mold resin layer.

(2) Statement of the Prior Art

A bayonet molded plug which is a kind of connector having a molded cable outlet is known by, for example, Japanese Utility Model Public Disclosure No. HEI 5-73871 (1993). This bayonet molded plug is produced by attaching a pair of bayonet terminals to a mold core made of a thermosetting resin, connecting an end of each core wire of an electrical cable to each terminal, and molding the core wires and mold core by a thermoplastic resin. Such structure has the advantage of enhancing waterproofing and impact strength since exposed core wires are covered with a resilient mold resin layer.

However, various problems on forming are caused when the above mold structure is applied to a connector in which terminal metal fixtures are accommodated in a cavity within a connector housing. If the cable outlet of the connector housing is molded merely by a mold resin, the mold resin will enter the cavity by an injection pressure upon forming, so that the mold resin will reach an interior of a connection part of the terminal metal fixture. In order to prevent such leakage, it is necessary to seal one end of the cavity. However, it is difficult to effect sealing of the cavity at its end, since the injection pressure of the mold resin will become substantially higher and the core conductors pass through the end of the cavity. If the injection pressure is lowered to prevent the leakage of the mold resin, the efficiency of production will be reduced.

On the other hand, in the case of a molded type connector having such structure requiring a better waterproofing function, the cost of production will be abruptly increased for the following reasons:

In such molded type connector, entering paths of water in question are a boundary space between a mold resin layer and a sheath of an electrical cable and a boundary space between the mold resin layer and a connector housing.

Boundary portions between mold resin parts are likely to have difficulties in adherence to each other when they have a poor appetency and cause a gap therebetween on account of differences of thermal expansion and contraction during a cooling process on molding or a change of temperature while in use. Accordingly, it is necessary to select a resin material which has a good appetency to a sheath resin of the electrical cable and a mold resin of the connector housing and a low coefficient of thermal expansion.

However, the sheath resin of the electrical cable is polyethylene, crosslinking polyethylene, or fluorocarbon polymer while the connector housing is made of PBT (polybutylene terephthalate) or PPS (polyphenylene sulfide). Thus, both materials are generally different. It is difficult to select a mold resin suitable for both resins. Consequently, an expensive mold resin is inevitably selected and materials of the sheath resin of the electrical cable and the connector housing must be reconsidered.

SUMMARY OF THE INVENTION

An object of the present invention is to provide a waterproofed connector in which the outlet of an electrical cable can be molded by resin without causing a problem of mold resin leakage regardless of the structure in which a terminal metal fixture is inserted in a cavity in a connector housing.

Another object of the present invention is to provide a waterproofed connector which can be produced at a low cost and perform a superior waterproofing function.

In order to achieve the above objects, a waterproofed connector in accordance with the present invention comprises: a connector housing having a cavity provided with a terminal insertion opening; terminal metal fixtures each of which is connected to an end of each core wire of an electrical cable and inserted into the cavity through the terminal insertion opening; a plug body having through holes each of which permits the core wire to pass through and enter into the cavity through the terminal insertion opening; and a mold resin layer enclosing a rear end of the connector housing and an end of the electrical cable with the terminal metal fixtures and plug body being accommodated in the cavity in the connector housing.

The plug body may be provided with a slit extending from the exterior to each through hole.

The plug body may be made of a resilient material.

The plug body may be provided on a front end face with a plurality of vertical ridges, on a rear end with a flange, and on a middle portion with a barrel-like bulged portion.

A rear end of the connector housing embedded in the mold resin layer may be provided with a plurality of through holes for enhancing a connection between the housing and the layer.

According to the waterproofed connector of the present invention, it is possible to prevent the mold resin from leaking into an inner part in the cavity upon molding, since the plug body is inserted through the terminal insertion opening in the connector housing into the cavity. In the case of the plug body being made of an elastic material, the plug body can make close contact with the interior of the accommodating chamber, thereby positively preventing the mold resin from leaking into the cavity and enhancing the waterproofing function. Consequently, even if a gap is formed between the connector housing and the mold resin layer and between the electrical cable and the mold resin layer to permit water to enter through the gap into the cavity, the plug body can certainly prevent water from entering into the side of the terminal metal fixture in the cavity. Thus, it is possible to select a material suitable for a mold resin layer preferentially in view of a cost and a work without considering the appetency and difference of the coefficient of thermal expansion between the sheath material of the electrical cable and the connector housing material.

Each core wire can be inserted into each through hole through each slit formed in the plug body.

In the present invention, the leakage of mold resin can certainly be prevented and an injection pressure can be set at high since the elastic plug body fits firmly into the interior of the cavity, thereby maintaining a high level of production efficiency. Moreover, since the plug body can perform the waterproofing function, it is possible to prevent water from entering into the side of the terminal metal fixture in the cavity even if a gap is formed between the connector housing and the mold resin layer and between the sheath resin of the electrical cable and the mold resin layer. Accordingly, it is possible to freely select various kinds of material in view of the cost and the like without considering the gap. The present invention can reconcile a low cost and a high level of waterproofing.

A step of passing the core wire into the plug body can be simplified, increasing production efficiency, and reducing the cost of production.

On the other hand, in order to achieve the above objects, the waterproofed connector according to the present invention, in addition to the structure of the waterproofed connector described above, includes a plug body made of a hard plastic material. The exterior of the plug body and the interior of an accommodating chamber for the plug body in the cavity are tapered so that the exterior and interior make close contact with each other.

The plug body may be divided into a pair of half parts. The divided plug body is inserted into the accommodating chamber in the cavity through the terminal insertion opening with the half parts clamping the core wires.

The divided plug body may include an upper half part and a lower half part. The upper and lower half parts may be interconnected by a selfhinge. The half parts of the divided plug body may be provided with temporary locking portions for coupling to each other. The temporary locking portions may include an engaging hole and an engaging projection or an engaging recess and an engaging pawl. A rear end of the connector housing embedded in the mold resin layer may be provided with a plurality of through holes for enhancing a connection between the housing and the layer.

The waterproofed connector may further comprise a waterproofing seal inserted into an inner part of the cavity through the terminal insertion opening to firmly contact with an interior of the inner part of the cavity.

According to the waterproofed connector described above, it is possible to effectively prevent the mold resin from leaking into an inner part in the cavity upon molding since the plug body is inserted into the cavity through the terminal insertion opening in the connector housing. Moreover, since the exterior of the plug body and the interior of the accommodating chamber for the plug body in the cavity are tapered so that the exterior and interior make firm contact with each other, the plug body is pushed to the inner part in the cavity by an injection pressure of the mold resin upon molding, thereby enhancing a firm contact between the plug body and the connector housing and certainly effecting prevention of any leakage of the mold resin.

The divided plug body can clamp the core wires between the upper and lower half parts so that the core wires pass through the holes, respectively. The structure in which the temporary locking portions couple together with the pair of half parts can facilitate the insertion of the plug body into the terminal insertion opening.

As described above, in such molded type connector, entering paths of water in question are a boundary space between a mold resin layer and a sheath of an electrical cable and a boundary space between the mold resin layer and a connector housing.

Boundary portions between mold resin parts are likely to have difficulties in adherence to each other when they have a poor appetency and cause a gap therebetween on account of differences of thermal expansion and contraction during a cooling process on molding or a change of temperature while in use. Accordingly, it is necessary to select a resin material which has a good appetency to a sheath resin of the electrical cable and a mold resin of the connector housing and a low coefficient of thermal expansion.

However, the sheath resin of the electrical cable is polyethylene, crosslinking polyethylene, or fluorocarbon polymer while the connector housing is made of PBT (polybutylene terephthalate) or PPS (polyphenylene sulfide). Thus, both materials are generally different. It is difficult to select a mold resin suitable for both resins. Consequently, an expensive mold resin is inevitably selected and materials for the sheath resin of the electrical cable and the connector housing must be reconsidered.

On the contrary, in the case that the waterproofing seals are provided in an inner part over the plug body in the cavity so as to make close contact with the interior of the cavity, it is possible to obtain substantial waterproofing by means of the waterproofing seals. It is also possible to prevent water from entering into the side of the terminal metal fixture even if a gap is formed between the connector housing and the mold resin layer and between the sheath resin of the electrical cable and the mold resin layer.

As mentioned above, according to the present invention, the leakage of mold resin can certainly be prevented and an injection pressure can be set at high since the elastic plug body fits firmly into the interior of the cavity by the injection pressure of the mold resin upon molding, thereby maintaining a high level of production efficiency.

It is also possible to omit the step of passing the core wires through the plug body. Although the plug body is divided into two half parts, the plug body can be readily inserted into the cavity, since the two half parts can be joined together at the terminal insertion opening.

Further, since the waterproofing seals can perform the waterproofing function, it is possible to prevent water from entering to the side of the terminal metal fixture even if a gap is formed between the connector housing and the mold resin layer and between the sheath resin of the electrical cable and the mold resin layer. Accordingly, it is possible to freely select various kinds of material in view of the cost and the like without considering the gap. The present invention can reconcile a low cost and a high level of waterproofing.

Further, in order to achieve the above objects, the waterproofed connector according to the present invention, in addition to the structure of the waterproofed connector described above, includes a connector housing having a cavity provided with a terminal insertion opening; terminal metal fixtures each of which is connected to an end of each core wire of an electrical cable and inserted into the cavity through the terminal insertion opening; a plug body having through holes each of which permits the core wire to pass through an inserted into the cavity through the terminal insertion opening, the plug body being made of a hard plastic material and formed into a rectangular configuration divided into upper and lower half parts; a waterproofing seal inserted into an inner part of the cavity through the terminal insertion opening to make close contact with the interior of the inner part of the cavity; and a mold resin layer enclosing a rear end of the connector housing and an end of the electrical cable with the terminal metal fixtures and plug body being accommodated in the cavity in the connector housing. The upper and lower half parts may be interconnected by a selfhinge. The half parts of the divided plug body may be provided with temporary locking portions for coupling with each other. The temporary locking portions may include an engaging hole and an engaging projection or an engaging recess and an engaging pawl. A rear end of the connector housing embedded in the mold resin layer may be with a plurality of through holes for enhancing a connection between the housing and the layer.

Since the waterproofing seals as well as the mold resin layer are provided in the terminal insertion opening in the cavity in the present invention, it is possible to prevent water from entering into the side of the terminal metal fixture even if a gap is formed between the connector housing and the mold resin layer and between the sheath resin of the electrical cable and the mold resin layer.

It is also possible to prevent the mold resin from energetically flowing into the side of the waterproofing seals in the cavity upon forming the mold resin layer, since the plug body is disposed in the terminal insertion opening.

The divided plug body can clamp the core wires between the upper and lower half parts so that the core wires pass through the holes, respectively. The structure in which the temporary locking portions couple together with the pair of half parts can facilitate the insertion of the plug body into the terminal insertion opening.

As described above, according to the present invention, since the plug body can perform the waterproofing function, it is possible to prevent water from entering into the side of the terminal metal fixture even if a gap is formed between the connector housing and the mold resin layer and between the sheath resin of the electrical cable and the mold resin layer. Accordingly, it is possible to freely select various kinds of material in view of the cost and the like without considering the gap. The present invention can reconcile a low cost and a high level of waterproofing.

In particular, since the plug body can prevent the mold resin from energetically flowing into the side of the waterproofing seals in the cavity upon molding, it is possible to prevent the mold resin from pushing the waterproofing seals toward the terminal metal fixture and from flowing into the fixture. Consequently, it is possible to increase the injection pressure of the mold resin and to make a molding condition advantageous. Further, it is also possible to omit a step of passing the core wires through the plug body. Although the plug body is divided into two half parts, the plug body can be readily inserted into the cavity, since the two half parts can be joined together at the terminal insertion opening.

DETAILED DESCRIPTION OF THE PREFERRED EMBODIMENTS:

A first embodiment of a waterproofed connector in accordance with the present invention will be described below by referring to FIGS. 1 to 9.

Figure 1:
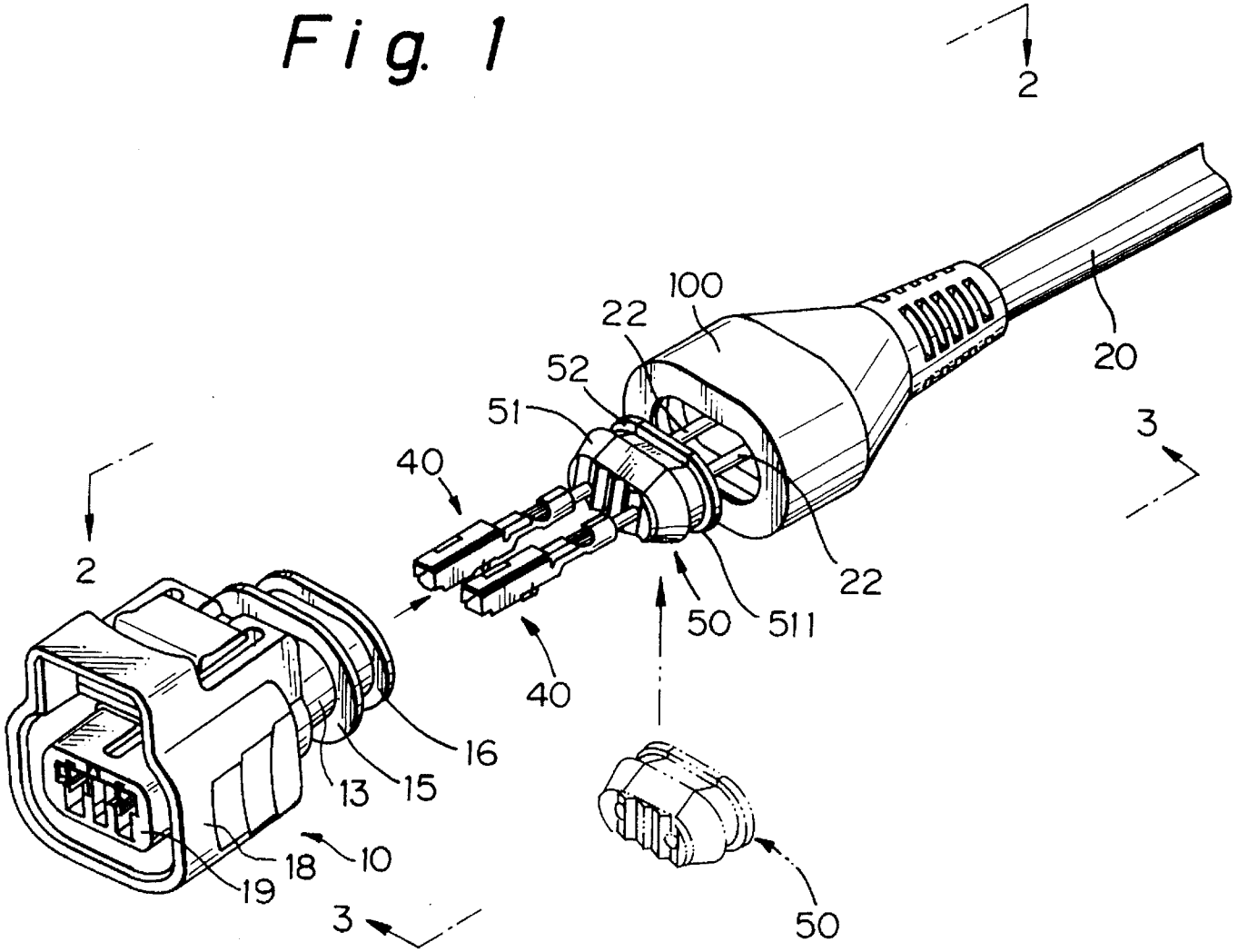
FIG. 1 is an exploded perspective view of a first embodiment of a waterproofed connector in accordance with the present invention.
Figure 2:
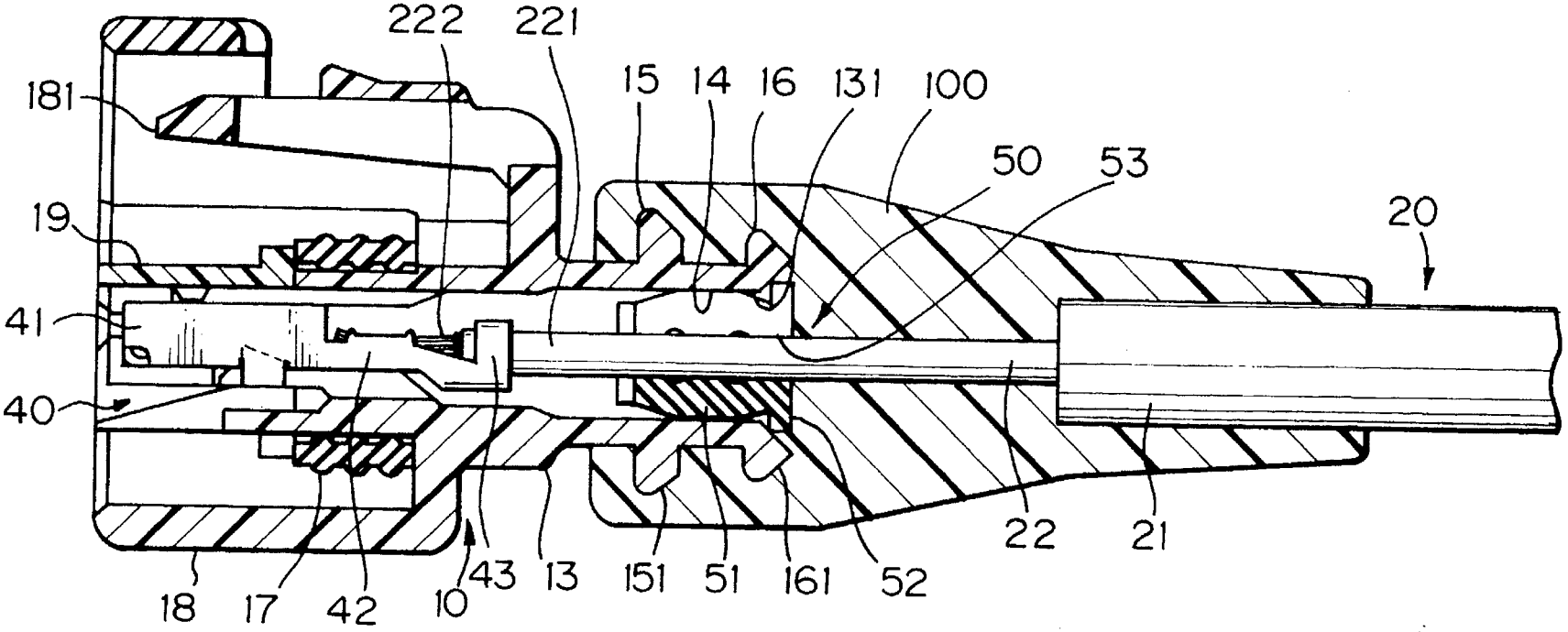
FIG. 2 is a longitudinal sectional view taken along line 2—2 in FIG. 1.
Figure 3:
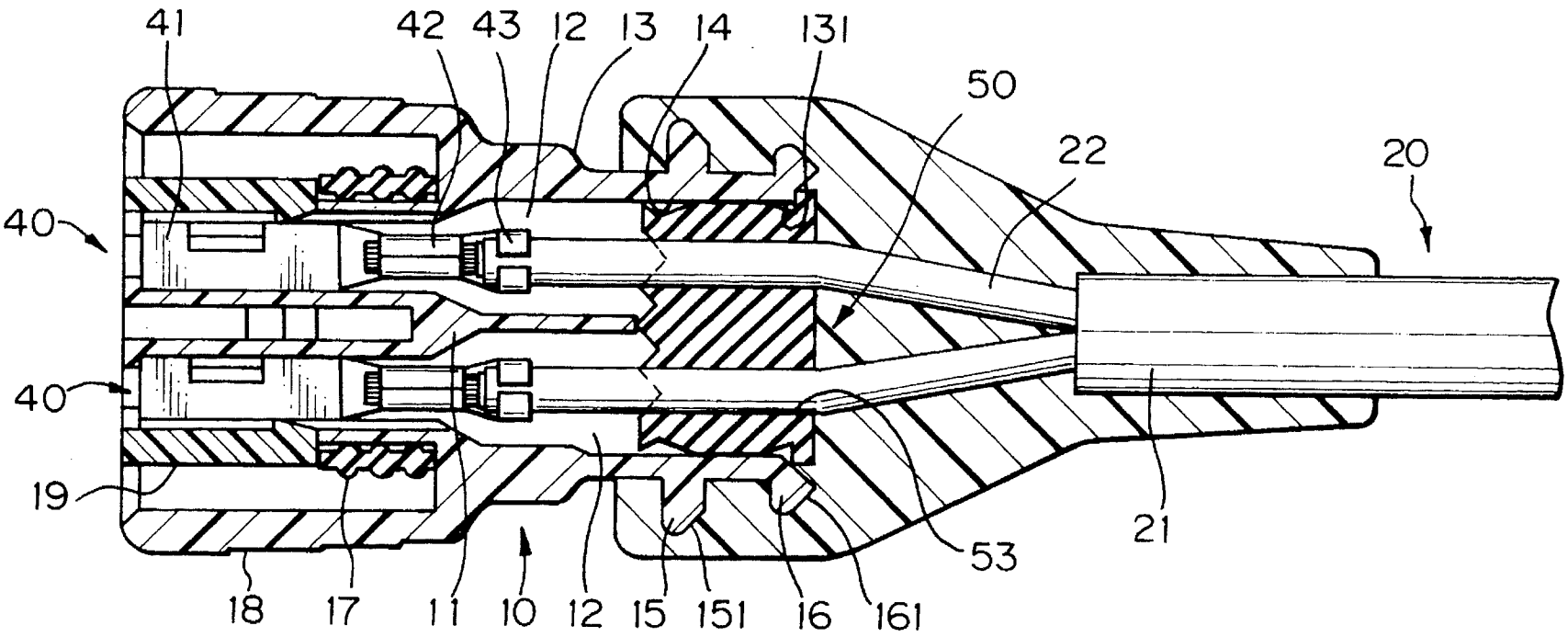
FIG. 3 is a longitudinal sectional view taken along line 3—3 in FIG. 1.

FIGS. 1 to 3 show a general structure of the waterproofed connector. A connector housing 10 is made of, for example, PBT. The connector housing 10 includes a terminal accommodating cylindrical portion 13 having two cavities 12 each of which is defined by a partition 11. A terminal metal fixture 40 is inserted into each cavity 12 through a terminal insertion opening 131 formed in a rear end part of the terminal accommodating cylindrical portion 13 (a right side in FIG. 3). The rear end part of the portion 13 (a right side in FIG. 3) is provided in its interior with no partition 11 which defines the cavity 12 so that a single plug body accommodating chamber 14 is formed to communicate with each cavity 12.

The terminal accommodating cylindrical portion 13 is provided on the exterior of the rear end part with annular ribs 15 and 16 spaced away from each other by a given distance. The annular rib 15 disposed in a front end side (a left side in FIG. 3) has an outer diametrical dimension larger than that of the annular rib 16 disposed in a rear end side (a right side in FIG. 3). The front side faces of the annular ribs 15 and 16 are flat and the rear side faces of them are formed into forwardly slanted faces 151 and 161.

On the other hand, a tubular waterproofing seal 17 is mounted on an outer periphery on a front end side of the terminal accommodating cylindrical portion 13. The portion 13 is provided on its front end with a hood 18 enclosing it. A mating connector housing (not shown) is adapted to be fitted in the hood 18 so that a locking piece 181 in the hood 18 engages with the mating connector housing. A retainer 19 serves to prevent the seal 17 from coming out of the portion 13 and the terminal metal fixtures 40 inserted in the respective cavities 12 in the portion 13 from coming out of the cavities 12.

On the other hand, an electrical cable 20 to be connected to this connector includes two core wires 22, which may be either merely covered with a sheath 21 or united together in the sheath 21. The sheath 21 is removed at its distal end to expose each core wire 22 and each insulation cover 221 is removed at its distal end to expose each of core conductors 222.

In this embodiment, there are two terminal metal fixtures 40 each of which is connected to a distal end of each core wire 22. The terminal metal fixture 40 is formed into a well known structure which includes a female type coupling portion 41, a wire barrel 42 adapted to clamp the core conductors 222 of the core wire 22, and an insulation barrel 43 adapted to clamp the insulation cover 221 of the core wire 22.

Figure 4:
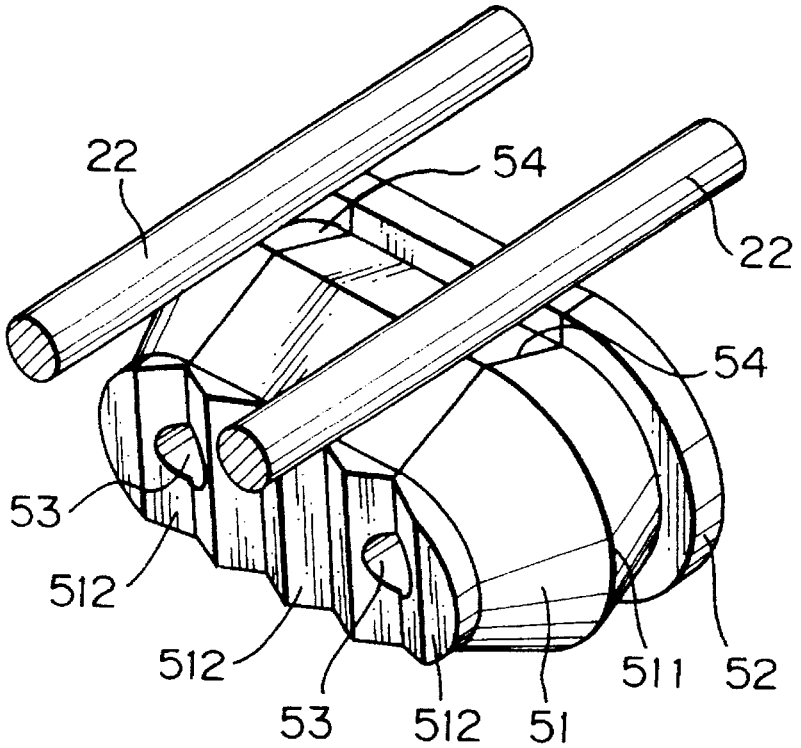
FIG. 4 is a perspective view of a plug body.
Figure 5:
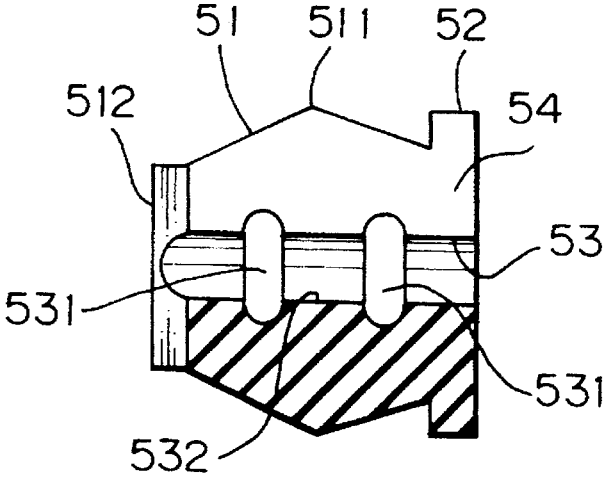
FIG. 5 is a longitudinal sectional view of the plug body shown in FIG. 4.

A plug body 50 made of a resilient synthetic rubber is inserted through a terminal insertion opening 131 into the plug body accommodating chamber 14 in the connector housing 10. As shown in FIGS. 4 and 5, the plug body 50 comprises a main part 51 and a flange 52 each having an oval cross section adapted to firmly contact with the interior of the chamber 14. The plug body 50 is provided with two wire through holes 53 each of which makes firm contact with the outer periphery of each core wire 22.

The main part 51 of the plug body 50 is provided on its middle section with an enlarged portion 511 which is adapted to firmly contact the interior of the chamber 14 when the plug body 50 is pushed into the chamber 14. The main part 51 is provided on its front end face with a plurality of linear ridges 512. The main part 51 and flange 52 are provided in their upper portion with slits 54 each extending along the wire through holes 53 and communicating with the holes 53. Each core wire 22 can be inserted through each slit 54 into each hole 53 from a position shown in FIG. 4 to a position shown in FIG. 1. As shown in FIG. 5, the core through hole 53 is provided with two annular grooves 531 spaced axially to define close contact areas 532 on the inner peripheral face of the hole 53.

The connector housing 10 is provided on its rear end with a mold resin layer 100 which is formed by means of an injection molding process using a resilient synthetic rubber. A front end of the mold resin layer 100 encloses a rear end of the terminal accommodating cylindrical portion 13 while a rear end of the layer 100 is tapered to enclose a front end of the sheath 21 of the electrical cable 20. Although the mold resin layer 100 is separated from the connector housing 10 in FIG. 1 for convenience of explanation, the mold resin layer 100 is secured to the connector housing 10 in fact to enclose the portion 13. Thus, in fact the mold resin layer 100 cannot be disconnected from the connector housing 10.

Next, a process for producing the embodiment of the waterproofed connector in accordance with the present invention will be explained below.

The terminal metal fixture 40 is crimped onto the distal end of each core wire 22 of the electrical cable 20 and the plug body 50 is attached to a section near the end of the core wire 22. Upon mounting the plug body 50 on the core wires 22, the plug body 50 is disposed under the core wires 22 so that the slits 54 in the plug body 50 are opposed to the core wires 22 and then each core wire 22 is pressed into each hole 53 through each slit 54 while elastically deforming the plug body 50 to open the slit 54. Thus, the plug body 50 is attached to the core wires 22 as shown by solid lines in FIG. 1, as if the core wires 22 pass through the plug body 50.

Then, each terminal metal fixture 40 is inserted into each cavity 12 in the connector housing 10, the retainer 19 is pushed to an engaging position in the housing 10 to prevent the terminal metal fixture 40 from coming out of the cavity 12, and the plug body 50 is pushed into the chamber 14 in the connector housing 10. Thus, the plug body 50 is secured in the connector housing 10 to close the opening 131 in the connector housing 10.

Figure 6:
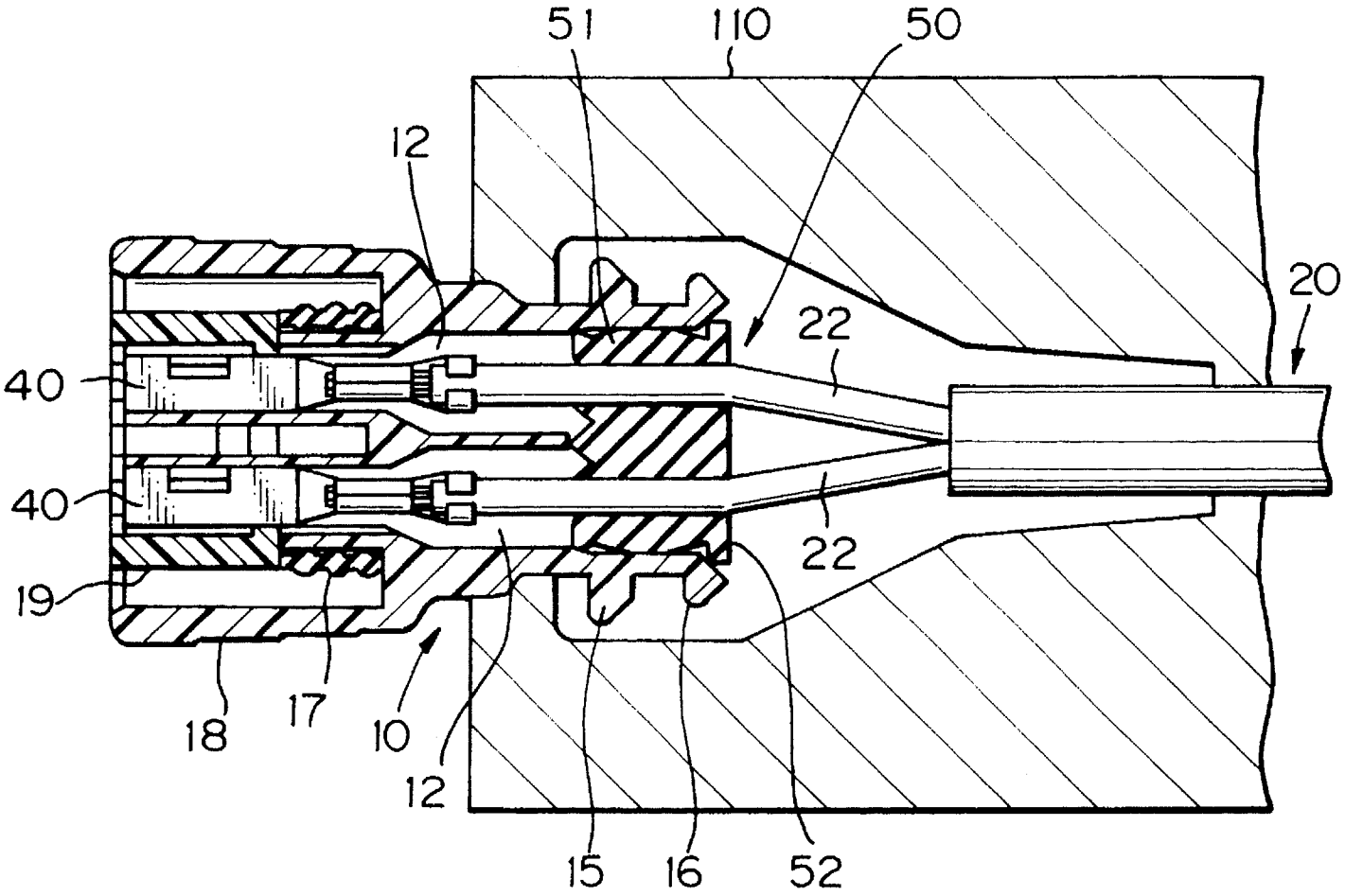
FIG. 6 is a longitudinal sectional view of the first embodiment, illustrating a process of forming a mold resin layer.

As shown in FIG. 6, the connector housing 10 in this state is set in a mold 110 and a mold resin is injected into the mold 110 under a given injection pressure to fill the mold 110 with the mold resin. Then, a mold resin layer 100 is formed. It is possible at this time to prevent the mold resin from entering the cavity 12 in the connector housing 10 since the plug body 50 closes the opening 131 in the connector housing 10. When the plug body 50 is further pushed into the connector housing 10 by the injection pressure of the mold resin in the mold 110, the flange 52 formed on the plug body 50 makes firm contact with the inner end of the opening 131 in the connector housing 10, thereby preventing the mold resin near the opening from leaking into the cavity 12.

The effects of this embodiment will be described below.

It is possible to prevent the water from entering the connector housing 10 through a cable inlet, since the rear end of the connector housing 10 and the cable inlet for the electrical cable 20 are covered with the mold resin layer 100. The resilient mold resin layer 100 can follow any bend in the electrical cable 20, thereby maintaining the waterproofing function and is not broken by any hit of stones or the like when a moving vehicle spatters the stones or the like, thereby enhancing the reliability of the connector housing 10.

It is possible in this embodiment to prevent the mold resin from flowing into the cavities 12 toward the terminal metal fixtures 40 under a high injection pressure during formation of the mold resin layer 100, since the plug body 50, through which the core wires 22 pass, is disposed in the terminal insertion opening 131. In addition, it is possible to enhance the sealing function and to prevent the mold resin from leaking into the connector housing 10, since the plug body 50 made of a resilient material firmly contacts with the interior of the plug body accommodating chamber 14.

Since the plug body 50 made of a resilient material can perform a high sealing function, the plug body 50 demonstrates in the chamber 14 the following unexpected advantages as well as the advantage of waterproofing.

The connector having the mold resin layer united together on the rear end of the connector housing 10 in this embodiment displays a high waterproofing function. However, it is necessary to carefully select materials of the connector housing 10 and mold resin layer 100 in order to obtain a complete waterproofing function. Boundary portions between mold resin parts are likely to have difficulties in adherence to each other when they have a poor appetency and cause gaps therebetween on account of differences of thermal expansion and construction during a cooling process on molding or a change of temperature while in use. Such gaps possibly deteriorate the waterproofing function.

However, the sheath resin of the electrical cable is polyethylene, crosslinking polyethylene, or fluorocarbon polymer while the connector housing is made of PBT (polybutylene terephthalate) or PPS (polyphenylene sulfide). Thus, both materials are generally different. It is difficult to select a mold resin suitable for both resins. Consequently, an expensive mold resin is inevitably selected and materials of the sheath resin of the electrical cable and the connector housing must be reconsidered.

In this embodiment, since the plug body 50 which is provided in itself to prevent the mold resin from leaking into the cavity 12 can demonstrate the waterproofing function, even if a gap formed between the connector housing and the mold resin layer 100 and between the sheath resin 21 of the electrical cable 20 and the mold resin layer. Accordingly, it is possible to freely select various kinds of material in view of the cost and the like without considering the gap. The present embodiment can reconcile a low cost and a high level of waterproofing.

The core wire 22 can be inserted into the hole 53 through the slit 54 formed in the plug body 50, thereby simplifying an assembly procedure and reducing the cost of production in comparison with a conventional construction in which the core wire must pass through the hole in the plug body at its distal end.

Two annular ribs 15, 16 formed on the rear end of the connector housing 10 can be firmly attached to the mold resin layer 100, thereby preventing the mold resin layer 100 from coming out of the connector housing 10.

Further, the projecting height of the annular rib 16 at a position near a resin injection gate is greater than that of the annular rib 15 at a position far from the resin injection gate. The annular ribs 15, 16 are provided on their rear side with the slant faces 151, 161. These structures ensure that the mold resin injected from the injection gate flows to all the corners in the mold, thereby suppressing generation of molding failures.

The present invention should not be limited to the above embodiment. For example, the following alterations should be included in the present invention. In order to avoid a repetition of explanation, the same elements or parts in each of the above alterations as those in the first embodiment are indicated by the same signs in the drawings and only different elements or parts will be described below.

Figure 7:
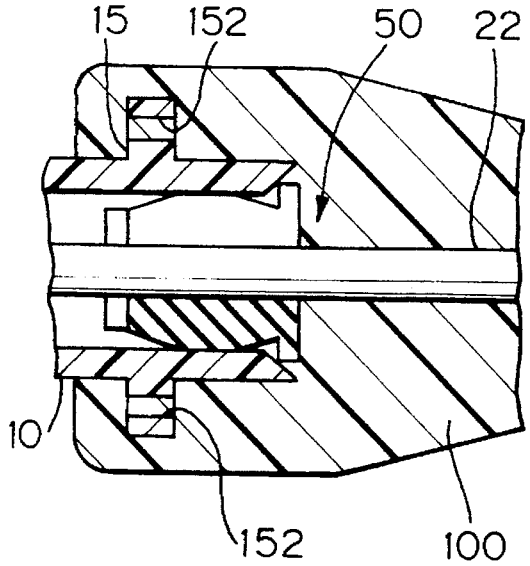
FIG. 7 is a partial longitudinal sectional view of a modified example of the first embodiment.
Figure 8:
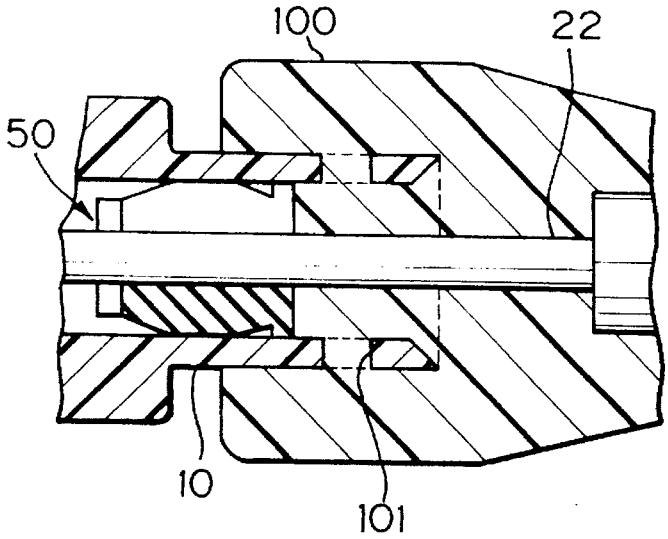
FIG. 8 is a partial longitudinal sectional view of another modified example of the first embodiment.

FIG. 7 shows a first alteration in which the mold resin 100 is strongly attached to the connector housing 10. In this alteration, the connector housing 10 is provided on its rear end with a single annular rib 15 which is provided with a plurality of wire through holes 152 into which the mold resin enters. This assures that the mold resin layer is prevented from coming out of the connector housing 10. Two annular ribs each having a plurality of through holes may be provided on the rear end of the connector housing 10 although they are not shown in the drawing.

Figure 9:
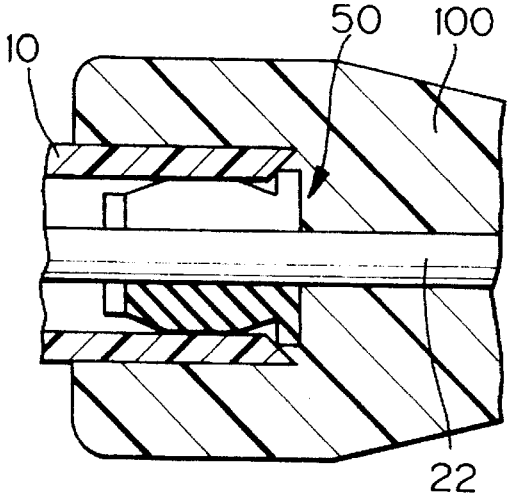
FIG. 9 is a partial longitudinal sectional view of still another modified example of the first embodiment.

The annular ribs 15 and 16 may not be provided on the connector housing 10. For example, in a second alteration shown in FIG. 8, the connector housing 10 may be provided in its rear end with a plurality of through holes 101 into which the mold resin enters, thereby preventing the mold resin layer 100 from coming out of the connector housing 10. If a small force is required to prevent the layer 100 from coming-out, a third alteration as shown in FIG. 9 may be provided with no annular ribs 15, 16 and through holes 101.

The plug body 50 is not limited to the above embodiment. For example, the plug body 50 may be tapered as described hereinafter, stepped (not shown) or conformed to the interior of the plug body accommodating chamber.

The present invention should not be limited to the above embodiments and alterations. For example, the plug body to which an adhesive, expansive agent or seal agent is applied may be disposed in the plug body accommodating chamber.

Next, a second embodiment of a waterproofed connector in accordance with the present invention will be described below by referring to FIGS. 10 to 43. Since the same signs in the second embodiment shown in FIGS. 10 to 43 as those in the first embodiment shown in FIGS. 1 to 9 indicate the same elements or parts, respectively, explanations of such structure and arrangement will be omitted below.

Figure 10:
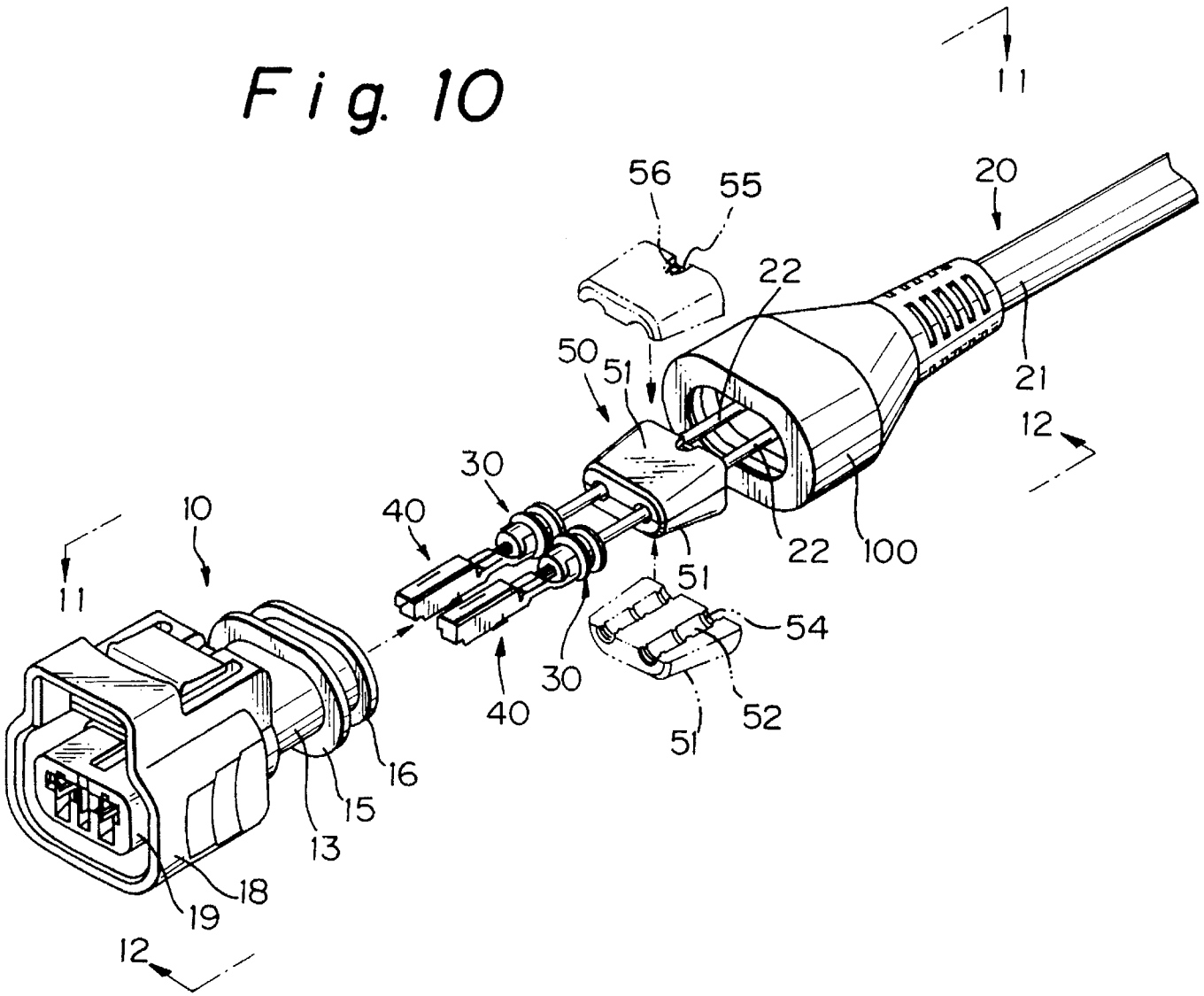
FIG. 10 is an exploded perspective view of a second embodiment of a waterproofed connector in accordance with the present invention.
Figure 11:
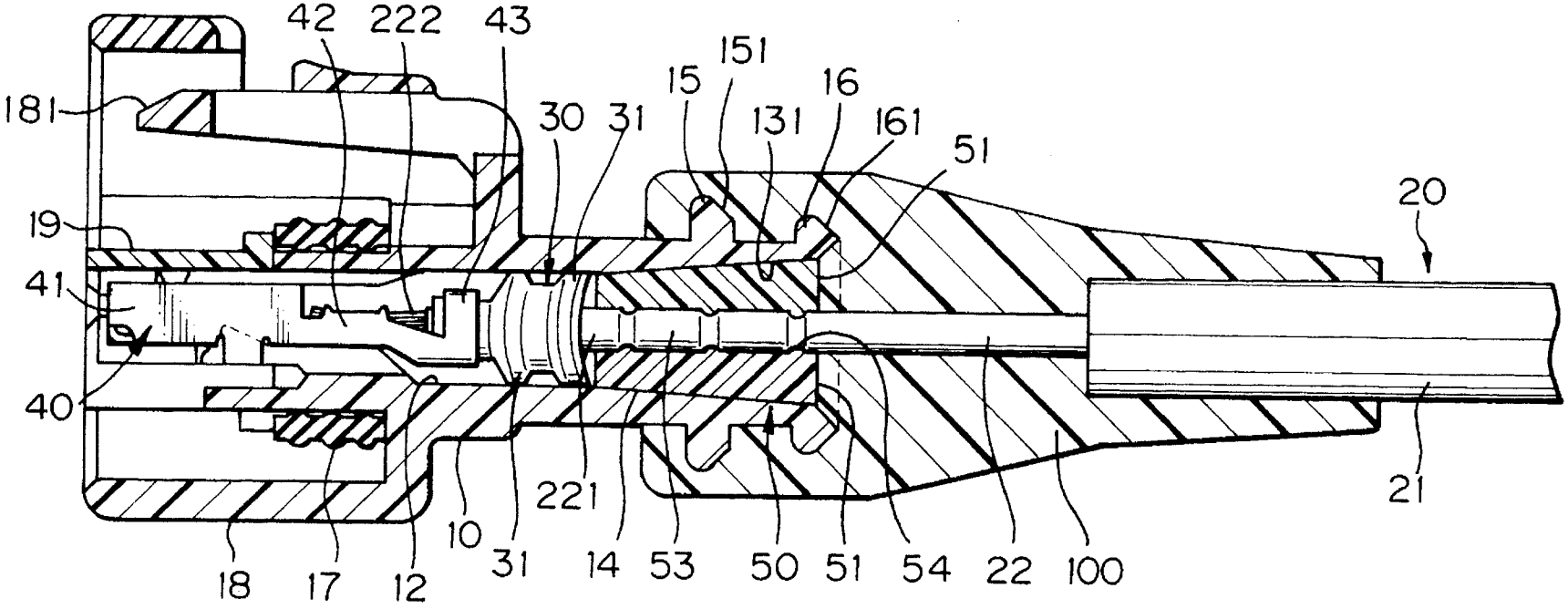
FIG. 11 is a longitudinal sectional view taken along line 11—11 in FIG. 10.
Figure 12:
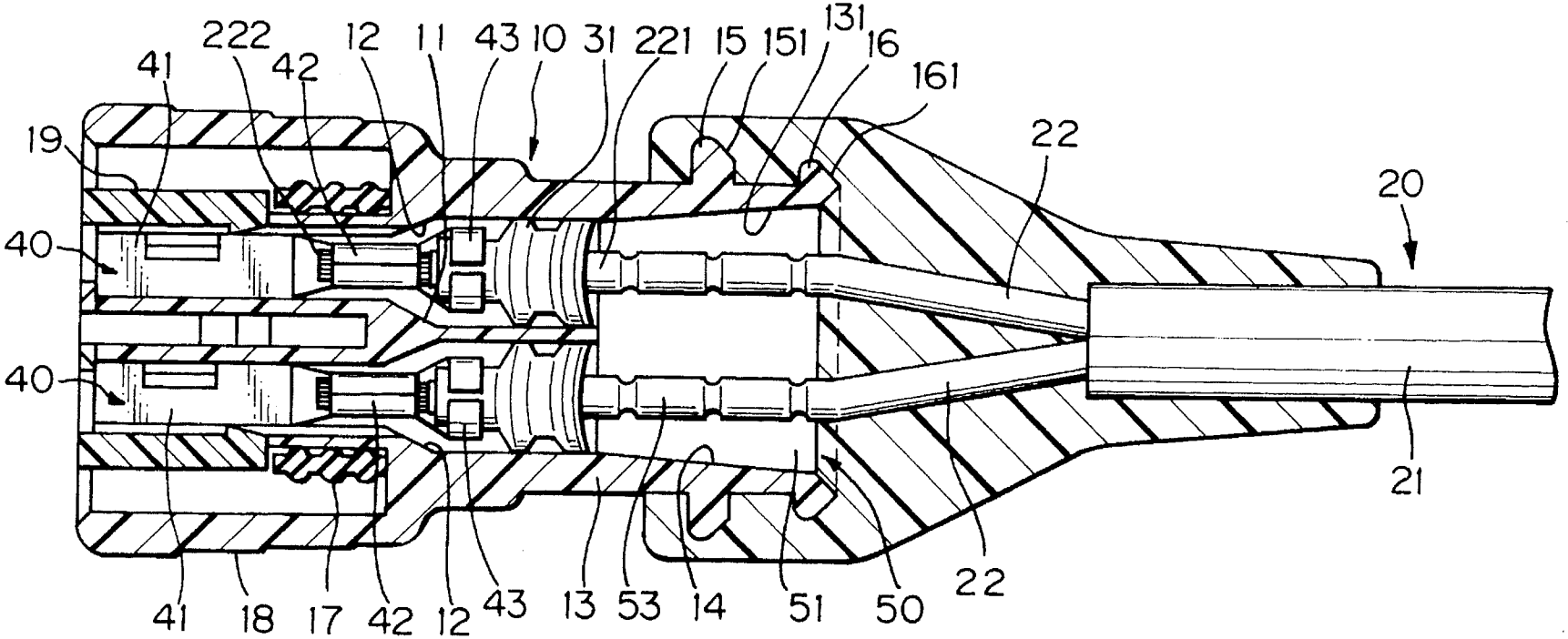
FIG. 12 is a longitudinal sectional view taken along line 12—12 in FIG. 10.

FIGS. 10 to 12 show a general structure of the waterproofed connector. A connector housing 10 is made of, for example, PBT. The connector housing 10 includes a terminal accommodating cylindrical portion 13 having two cavities 12 each of which is defined by a partition 11. A terminal metal fixture 40 is inserted into each cavity 12 through a terminal insertion opening 131 formed in a rear end part of the terminal accommodating cylindrical portion 13 (a right side in FIG. 12). The rear end part of the portion 13 (a right side in FIG. 12) is provided in its interior with no partition 11 which defines the cavity 12 so that a single plug body accommodating chamber 14 is formed to communicate with each cavity 12. The interior of the chamber 14 is tapered toward the inner part (the inner part of the cavity 12). The terminal accommodating cylindrical portion 13 is provided on its exterior of the rear end part with annular ribs 15 and 16 spaced away from each other by a given distance. The annular rib 15 disposed in a front end side (a left side in FIG. 3) has an outer diametrical dimension larger than that of the annular rib 16 disposed in a rear end side (a right side in FIG. 3). Front side faces of the annular ribs 15 and 16 are flat and rear side faces of them are formed into forwardly slanted faces 151 and 161.

On the other hand, an electrical cable 20 to be connected to this connector includes two core wires 22, which may be either merely covered with a sheath 21 or united together in the sheath 21. The sheath 21 is removed at its distal end to expose each core wire 22, the waterproofing seal 30 is mounted on the insulation cover 221 of a section near the distal end of each core wire 22, and each insulation cover 221 is removed at its distal end to expose each of core conductors 222.

In this embodiment, there are two terminal metal fixtures 40 each of which is connected to a distal end of each core wire 22. The terminal metal fixture 40 is formed into a well known structure which includes a female type coupling portion 41, a wire barrel 42 adapted to clamp the core conductors 222 of the core wire 22, and an insulation barrel 43 adapted to clamp the waterproofing seal 30.

The waterproofing seal 30 is made of a resilient synthetic rubber and is formed into a cylindrical shape. The seal 30 is provided with two annular lips 31 on its rear end to be crimped by the insulation barrel 43 of the terminal metal fixture 40. The lips 31 make firm contact with the interiors of the cavities 12 in the connector housing 10 to seal a space near the lips 31.

Figure 13:
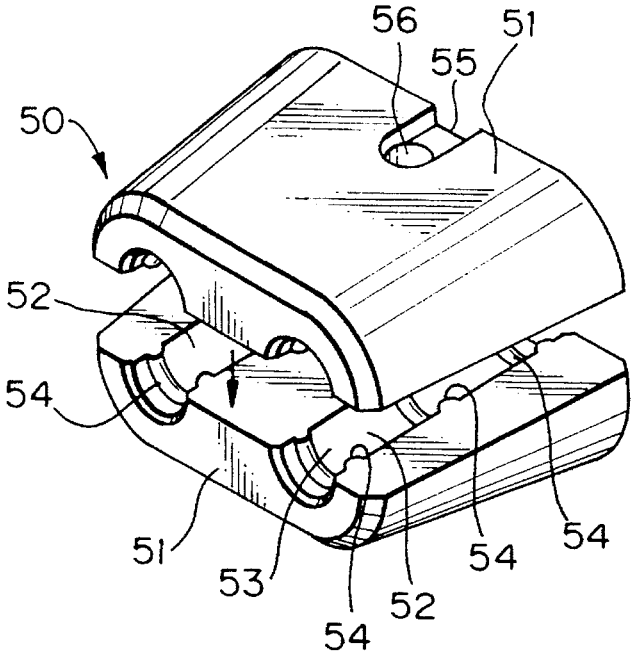
FIG. 13 is an exploded perspective view of a divided plug body in the second embodiment.

A plug body 50 made of a hard plastic material is disposed through the terminal insertion opening 131 in the plug body accommodating chamber 14 in the connector housing 10. As shown in FIG. 13, the plug body 50 is divided into a pair of upper and lower half parts 51 and 51 to clamp two core wires 22 core between the parts 51. Each half part 51 is provided with two U-shaped grooves on the fitting face to be coupled to the mating half part. When the half parts 51, 51 are coupled to each other, the opposed grooves 52 define wire through holes 53 for permitting the wires 22 to pass therethrough. Each half part 51 is tapered forwardly to conform to the interior of the plug body accommodating chamber 14. Consequently, the plug body 50 assembling the half parts 51, 51 is tapered forward, as shown in FIG. 13.

Three ridges 54 are formed peripherally and spaced axially or each groove 52 so that the ridges bite the insulation covers 221 of the core wires 22, thereby enhancing the sealing function between the front and rear ends in the plug body 50. As shown in FIG. 13, each half part 51 is provided in its upper end face with a recess 55 in which a receiving hole 56 is formed. A tool (not shown) can hook in the hole 56 to pull the part 51 out of the chamber 14.

Next, a process for producing the embodiment of the waterproofed connector in accordance with the present invention will be explained below.

The terminal metal fixture 40 is crimped on an end of each core wire 22 of the electrical cable 20 with the waterproofing seal 30 attached to a section near the end. The terminal metal fixture 40 is inserted into each cavity 12 in the connector housing 10 and then the retainer 19 is pushed onto a locking position to prevent the terminal metal fixture 40 from coming out of the cavity 12. Then, one of the half parts 51, 51 is inserted into the plug body accommodating chamber 14 through the terminal insertion opening 131 in the connector housing 10 while the half part 51 makes contact with the underside of the core wires 22. The other half part 51 is inserted into the chamber 14 through the opening 131 while the part 51 is in contact with the upside of the core wires 22. Two half parts 51, 51 clamp the core wires 22, 22, so that the core wires 22, 22 pass through the holes 53, 53 in the plug body 50, respectively. Upon inserting two half parts 51, if they 23 are firmly pushed into the chamber 14, the ridges 54 on the grooves 52 in each half part 51 bite the insulation cover 221 of the core wires 22. Consequently, the plug body 50 is compressed in the chamber 14 in the connector housing 10 while the plug body 50 firmly clamps the core wires 22.

Figure 14:
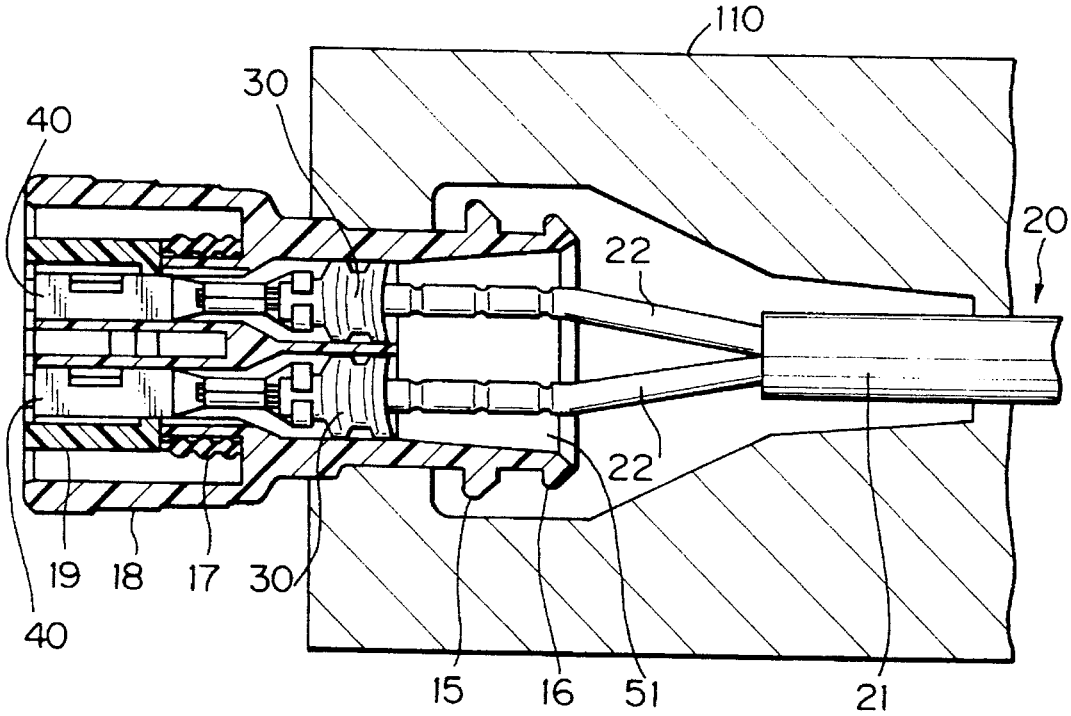
FIG. 14 is a longitudinal sectional view of the second embodiment, illustrating a process of forming a mold resin layer.

As shown in FIG. 14, the connector housing 10 in this state is set in a mold 110 and a mold rein is injected into the mold 110 under a given injection pressure to fill the mold 110 with the mold resin. Then, a mold resin layer 100 is formed. At this time, the plug body 50 is pushed to the inner part in the connector housing 10 by the injection pressure of the mold resin in the mold 110 so that the exterior of the plug body 50 makes firm contact with the interior of the connector housing 10, thereby preventing the mold resin from leaking into the cavities 12.

The effects of the second embodiment are as follows in addition to the effects of the first embodiment.

It is possible in this embodiment to prevent the mold resin from flowing into the cavities 12 toward the terminal metal fixtures 40 under a high injection pressure during formation of the mold resin layer 100, since the plug body 50, through which the core wires 22 pass, is disposed in the terminal insertion opening 131. Further, since the chamber 14 and the plug body 50 are tapered toward therein inner parts, it is possible to bring the plug body 50 into a close contact with the chamber 14 by utilizing the injection pressure of the mold resin, thereby preventing the mold resin from leaking into the cavities 12.

Minute gaps may be formed between the mold resin layer 100 and the connector housing 10 or the core wires 22 after molding. Since the present embodiment provides the mold resin layer 100 around the rear end of the connector housing 10 and the waterproofing seal 30 in the terminal insertion opening 131 of the cavities 12, the waterproofing seal 30 can prevent the water from entering the cavities 12 toward the terminal metal fixtures 40 even if the water enters the opening 131 through the gaps between the mold resin layer 100 and the core wires 22 or the connector housing 10.

It is also possible to raise the injection pressure of the mold resin. Even if the electrical cable 20 or the core wires 22 are subjected to any bending force, the plug body 50 maintains the core wires 22 at the center in the terminal insertion opening 131 so that the bending force is not transmitted to the waterproofing seal 30, thereby enhancing the waterproofing function of the seal 30.

Accordingly, it is possible to freely select various kinds of material for the connector housing 10, core wires 22, mold resin layer, or the like in view of the cost and the like without considering the gap. This embodiment can reconcile a low cost and a high level of waterproofing.

It is possible to permit the core wires 22 to pass through the holes 53 in the plug body 50 by clamping the core wires between the half parts 51, 51 divided from the plug body 50. Accordingly, the divided plug body 50 can simplify an assembly procedure and reduce the cost of production in comparison with the conventional structure in which the core wires pass through the holes in the plug body.

It is possible to pull the plug body 50 from the chamber 14 by hooking the engaging hole 56 formed in the top face of the half part 51 by means of a tool (not shown) in the case that insertion errors of the terminal metal fixture 40 is formed after the plug body 50 is inserted into the opening 131 in the connector housing 10.

The present invention should not be limited to the above embodiment. For example, the following alterations should be included in the present invention. In order to avoid a repetition of explanation, the same element or parts in each of the above alterations as those in the second embodiment are indicated by the same signs in the drawings and only different elements or parts will be described below.

Figure 15:
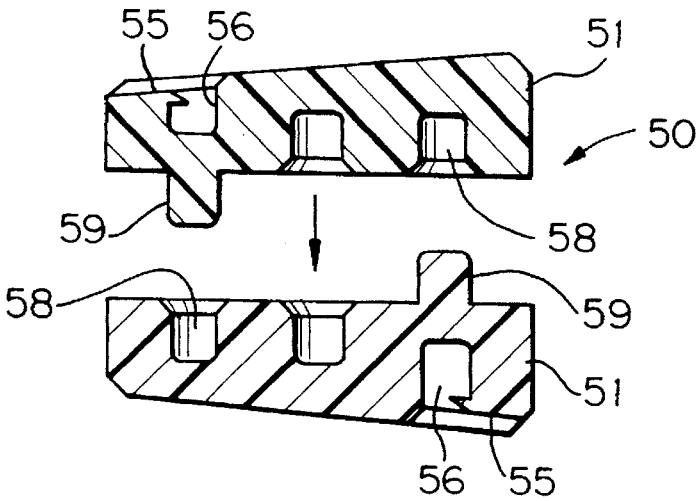
FIG. 15 is an exploded longitudinal sectional view of another divided plug body in the second embodiment of the present invention.
Figure 16:
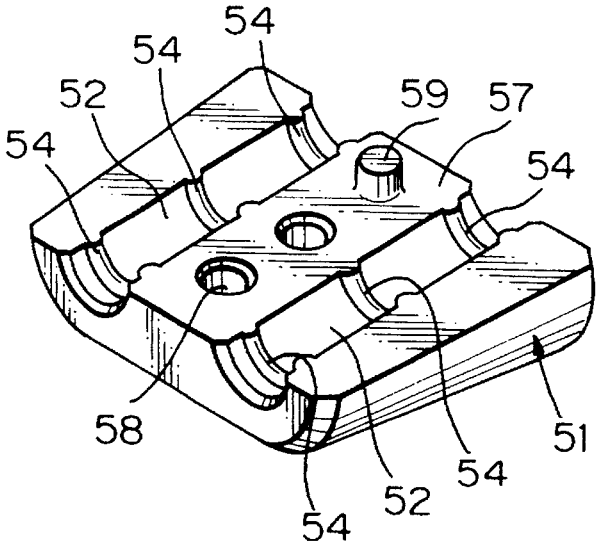
FIG. 16 is a perspective view of a half part of the divided plug body shown in FIG. 15.

FIGS. 15 and 16 show a first alteration of the plug body in the second embodiment of the present invention. The difference between the first alteration and the second embodiment is to provide the plug body 50 with a temporary locking portion which serves to lock the half parts 51, 51 temporarily.

Each half part 51 is provided with two grooves 52 and a flat portion 57 between the grooves 52 is provided in its front end with an engaging hole 58 and on its rear end with an engaging projection 59. When the pair of half parts 51, 51 are coupled to each other with the opposed grooves 52 clamping each core wire 22, the engaging projection 59 on one half part 51 is pressed into the engaging hole 58, thereby frictionally interconnecting the half parts 51, 51 to form a single plug body 50.

Since the pair of half parts 51, 51 are interconnected with the parts 51, 51 clamping the core wires 22, a worker can let go his hold after clamping. Accordingly, since the plug body 50 in which the half parts 51 clamp the core wires 22 can be inserted into the plug body accommodating chamber 14, a work of disposing the plug body 50 in the terminal insertion opening 131 before molding becomes easier than a work of disposing every half part 51 in the chamber 14 in the connector housing 10 in the second embodiment.

Figure 17:
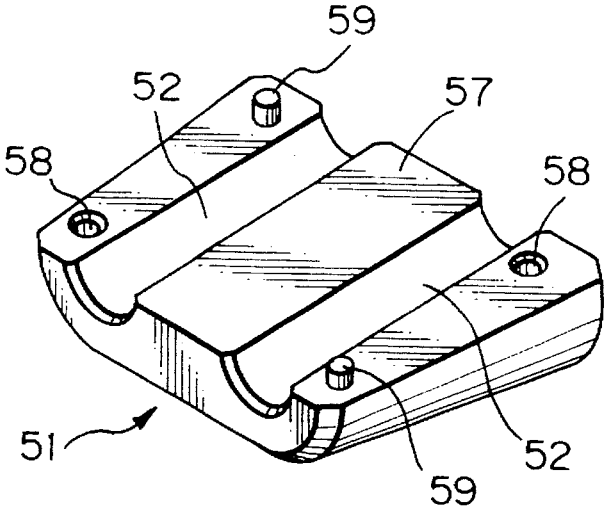
FIG. 17 is a perspective view of a half part of still another divided plug body in the second embodiment of the present invention.
Figure 18:
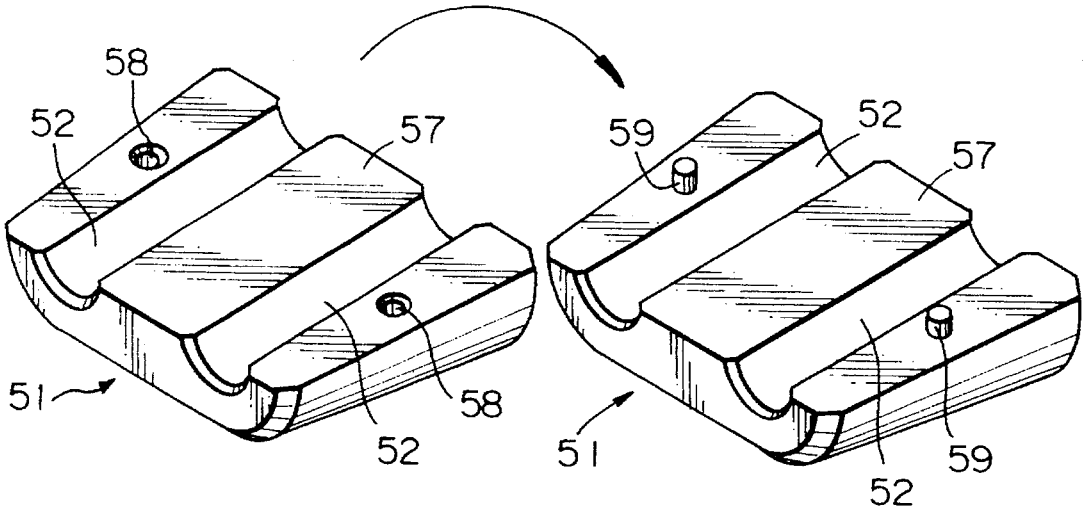
FIG. 18 is an exploded perspective view of still another divided plug body in the second embodiment of the present invention.
Figure 19:
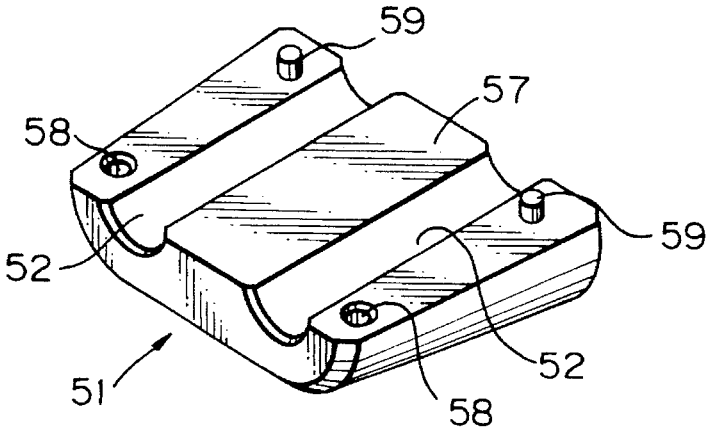
FIG. 19 is a perspective view of a half part of still another divided plug body in the second embodiment of the present invention.

As illustrated in the second alteration to the forth alteration shown in FIGS. 17 to 19, the engaging holes 58 and engaging projections 59 may be provided in and on the flat faces outside the grooves 52. In particular, in the case that the upper and lower half parts 51, 51 are the same shape as shown in the second alteration, only one kind of a mold can be utilized, thereby reducing the cost of a mold.

Figure 20:
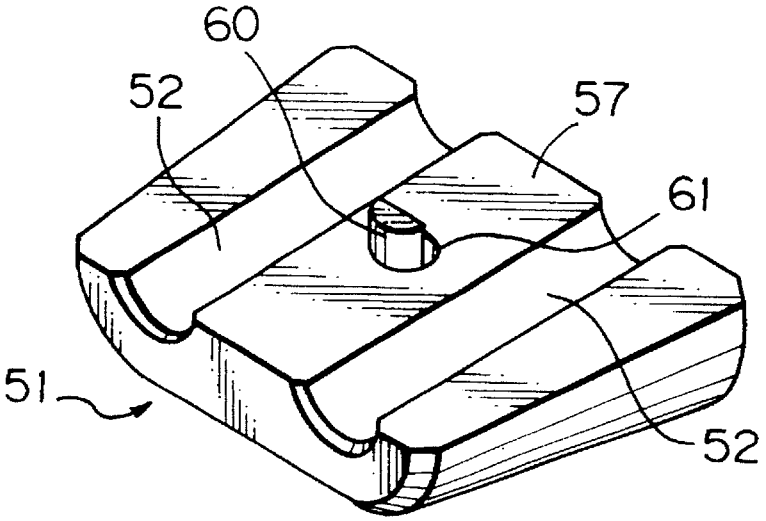
FIG. 20 is a perspective view of a half part of still another divided plug body in the second embodiment of the present invention.
Figure 21:
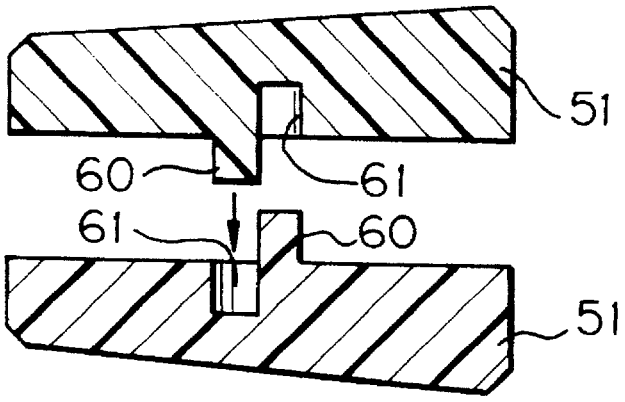
FIG. 21 is an exploded longitudinal sectional view of the divided plug body shown in FIG. 20.

In a fifth alteration shown in FIGS. 20 and 21, a semi-cylindrical engaging projection 60 is provided on the flat face 57 between the grooves 52 and a semi-circular aperture 61 is formed in the flat face 57 adjacent to the projection 60. The engaging projection 60 can be easily opposed to the engaging aperture 61 by sliding one half part 51 on the other half part 51 until both engaging projections join each other, with the half parts 51, 51 lightly clamping the core wires 22. Accordingly, this makes it easy to position the half parts 51, 51.

Figure 22:
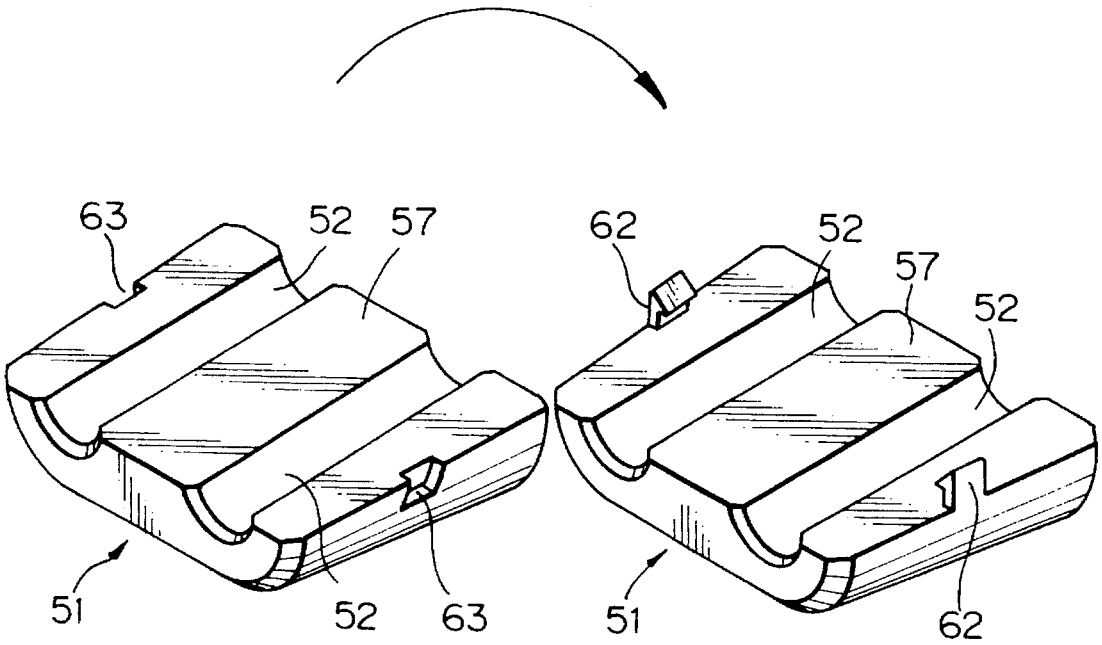
FIG. 22 is an exploded perspective view of still another divided plug body in the second embodiment of the present invention.
Figure 23:
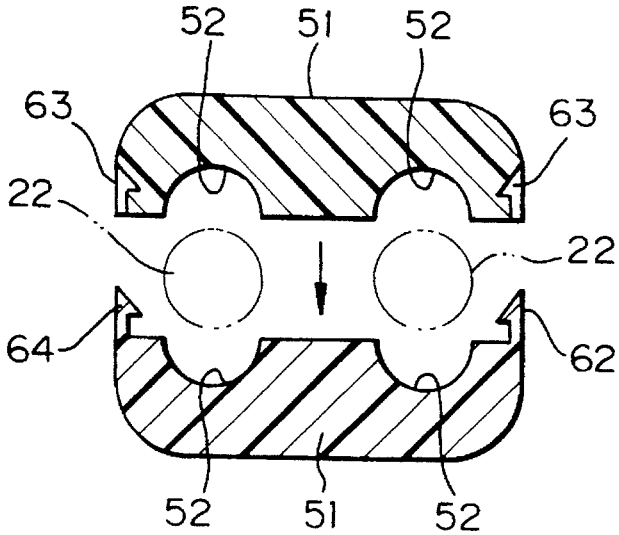
FIG. 23 is an exploded cross-sectional view of the divided plug body shown in FIG. 22.

A temporary locking mechanism for interconnecting the half parts 51, 51 is not limited to a combination of the engaging holes and projections as described in the first to the fifth alteration. The temporary locking mechanism may utilize engaging pawls as shown in a sixth alteration as illustrated in FIGS. 22 and 23.

One half part 51 is provided on its right and left sides with an engaging pawl 62 while the other half part 51 is provided in its right and left sides with an engaging recess 63 which is adapted to engage with the pawl 62. This mechanism can obtain a temporary locking force stronger than the mechanism comprising the engaging projections 59 and engaging holes 58. If the depth of the engaging recess 63 is set to completely receive the engaging pawl 62, any gap is hardly formed between the plug body 50 and the chamber 14 when the plug body 50 is inserted into the chamber 14, thereby enhancing a sealing function of the mold resin.

Figure 24:
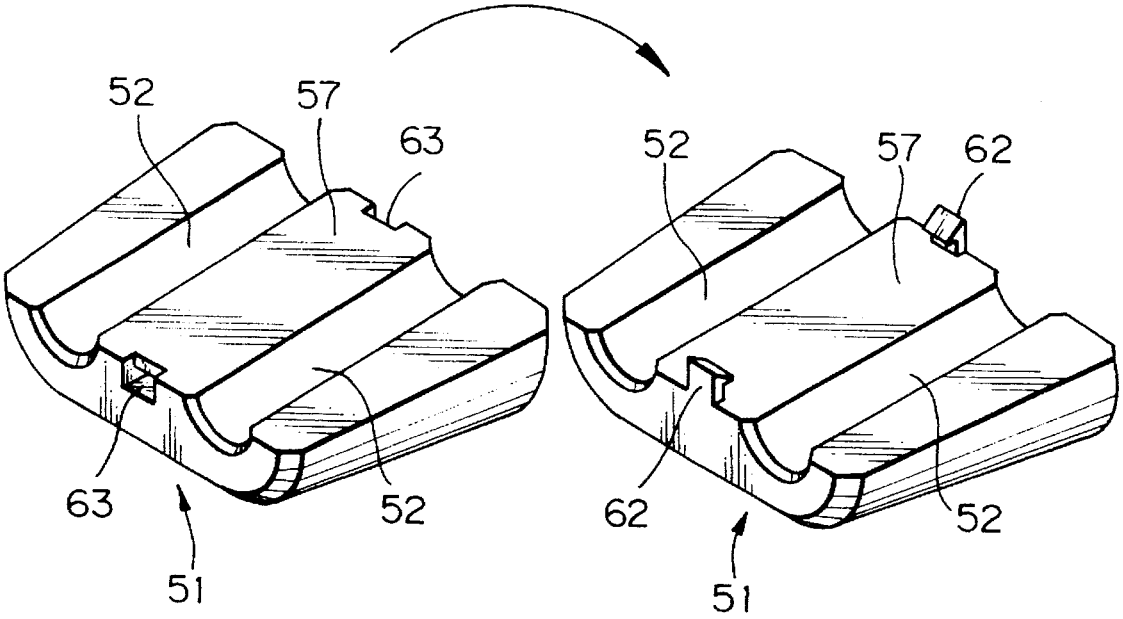
FIG. 24 is an exploded perspective view of still another divided plug body in the second embodiment of the present invention.
Figure 25:
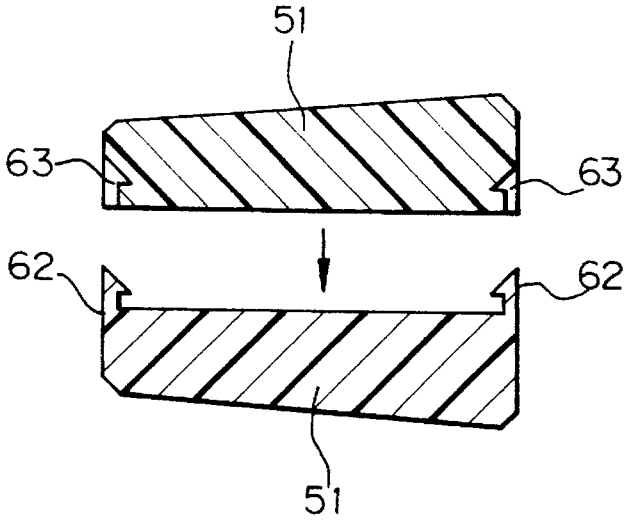
FIG. 25 is an exploded longitudinal sectional view of the divided plug body shown in FIG. 24.

The engaging projection 62 may be provided on the front and rear end of the half part 51, as shown in a seventh alteration illustrated in FIGS. 24 and 25.

Figure 26:
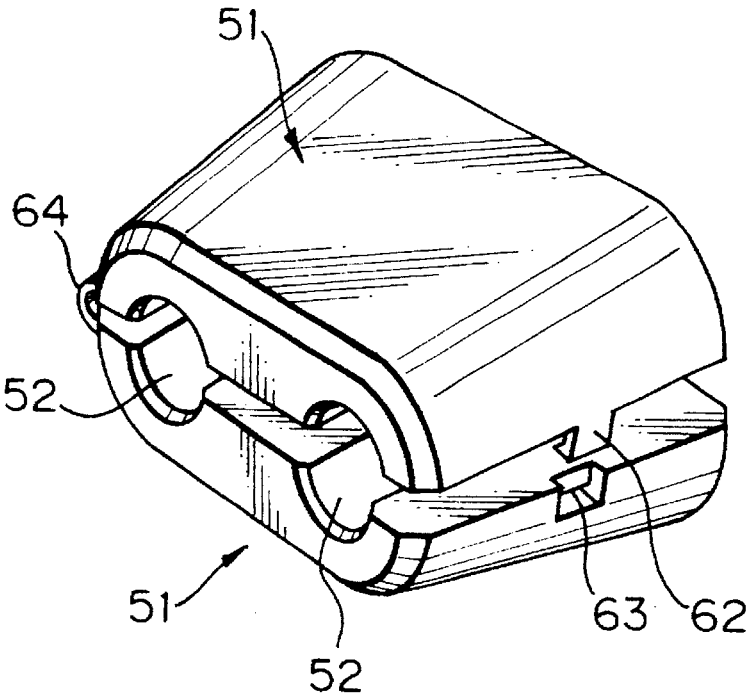
FIG. 26 is a perspective view of still another divided plug body in the second embodiment of the present invention.
Figure 27:
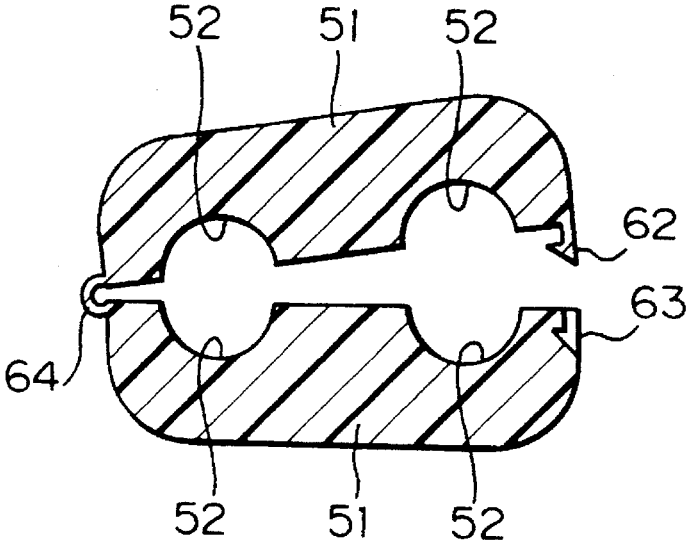
FIG. 27 is a cross-sectional view of the divided plug body shown in FIG. 26.

Moreover, in order to interconnect the half parts 51, 51, an eighth alteration shown in FIGS. 26 and 27 includes a selfhinge 64 which interconnects the half parts 51, 51 and the engaging pawls 62 and engaging recesses 63. This mechanism makes it possible to handle both half parts 51, 51 as a single part before clamping the core wires between the half parts 51, 51, thereby simplifying parts management during a production process.

Figure 28:
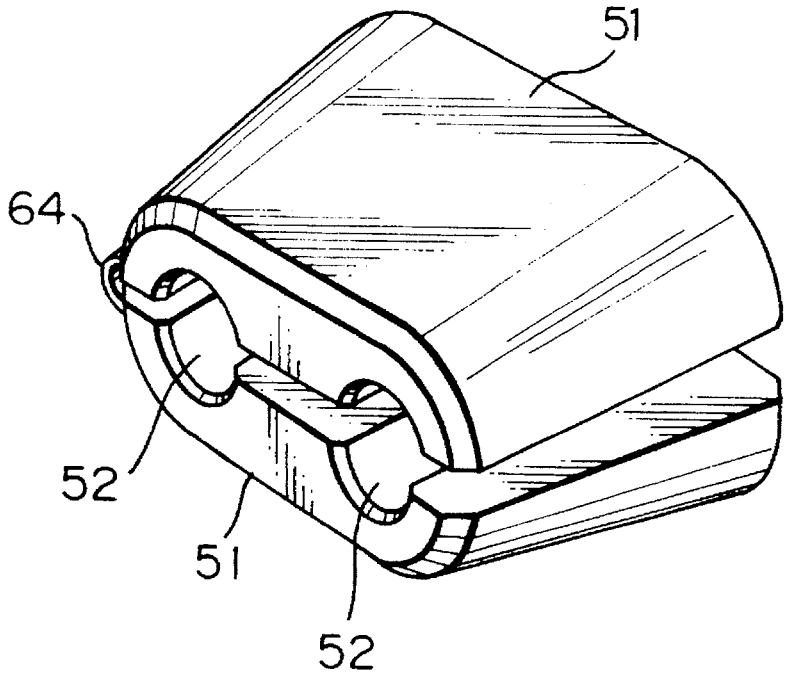
FIG. 28 is a perspective view of still another divided plug body in the second embodiment of the present invention.
Figure 29:
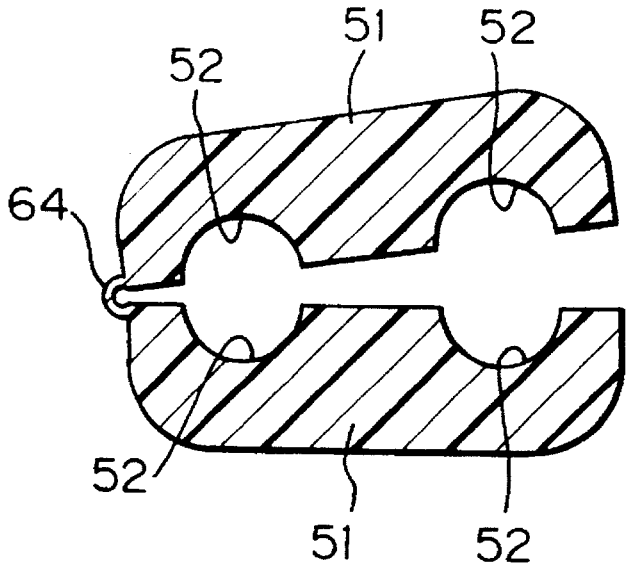
FIG. 29 is a cross-sectional view of the divided plug body shown in FIG. 28.

A ninth alteration shown in FIGS. 28 and 29 has only the selfhinge. This alteration, however, can also simplify parts management.

Figure 30:
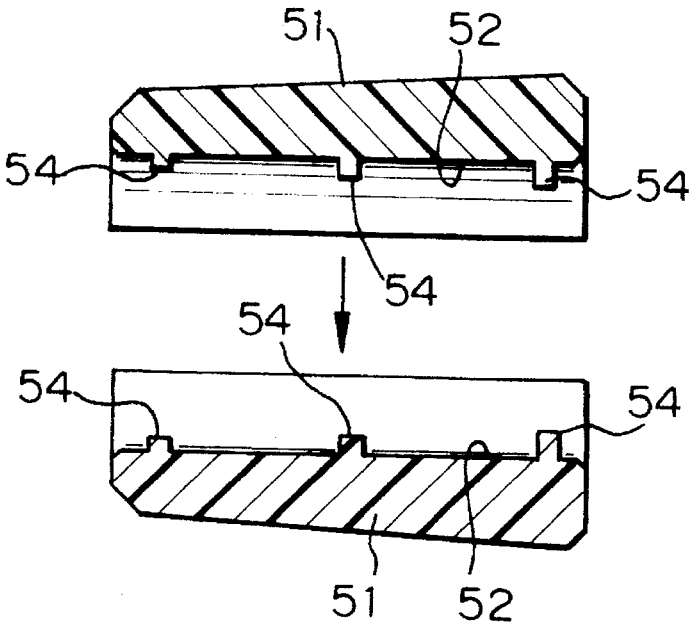
FIG. 30 is an exploded longitudinal sectional view of still another plug body in the second embodiment of the present invention.

FIG. 30 shows a tenth alteration. A difference between the tenth alteration and the second embodiment is to provide a structure of grooves in each half part 51 of the plug body. The other elements between them are the same.

Each half part 51 is provided with two grooves 52. Each groove 52 has three ridges 54 which extend circumferentially and are spaced axially. The heights of the ridges 54 are different and are increased toward the terminal insertion opening 131.

This can increase a sealing force toward the opening 131 and thus enhances a total waterproofing function.

Figure 31:
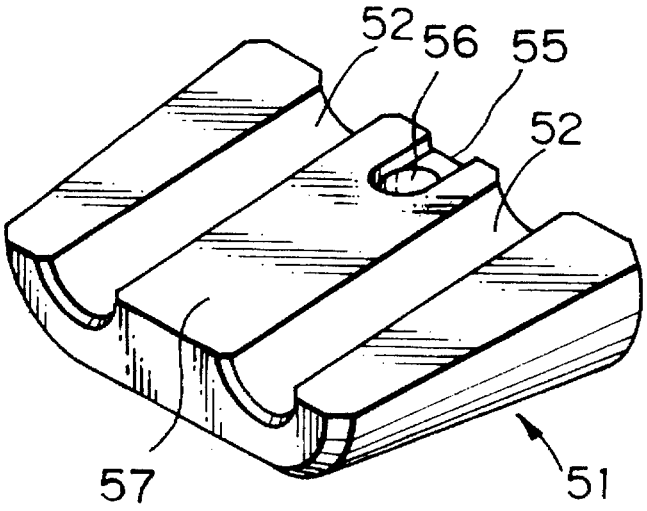
FIG. 31 is a perspective view of a half part of still another divided plug body in the second embodiment of the present invention.
Figure 32:
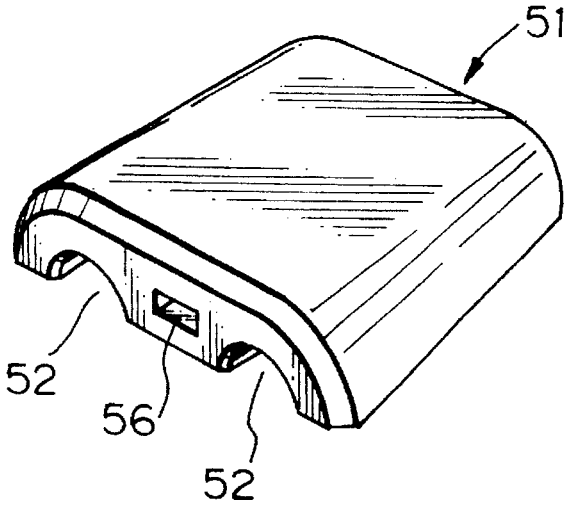
FIG. 32 is a perspective view of a half part of still another divided plug body in the second embodiment of the present invention.
Figure 33:
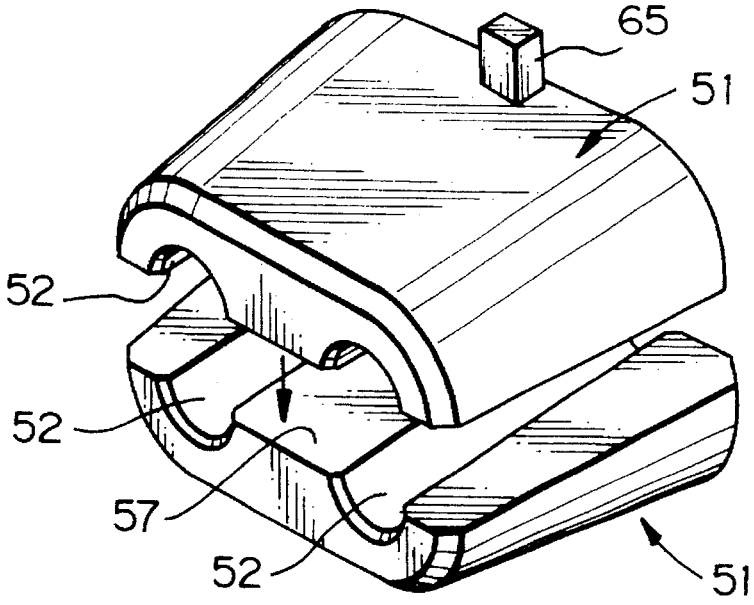
FIG. 33 is an exploded perspective view of still another divided plug body in the second embodiment of the present invention.

The recesses 55 and engaging holes 51 may be provided in and on the fitting face of the half part 51, as shown in an eleventh alteration illustrated in FIG. 31. A twelfth alteration shown in FIG. 32 is provided with the engaging hole 56 in the rear end face of the half part 51. Further, a thirteenth alteration shown in FIG. 33 is provided on the top face of the rear end of the half part 51 with an engaging projection 65 adapted to be hooked by a tool (not shown) to pull out the half part 51 from the connector housing 10.

Figure 34:
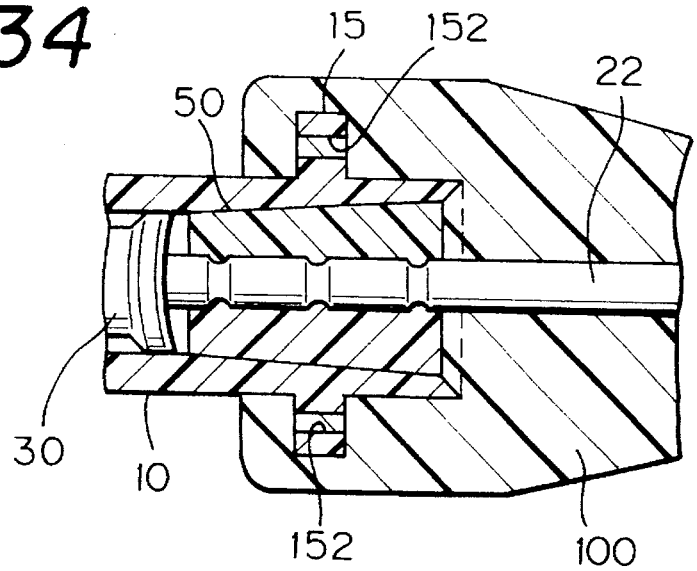
FIG. 34 is a partial longitudinal sectional view of another connector housing in the second embodiment of the present invention.
Figure 35:
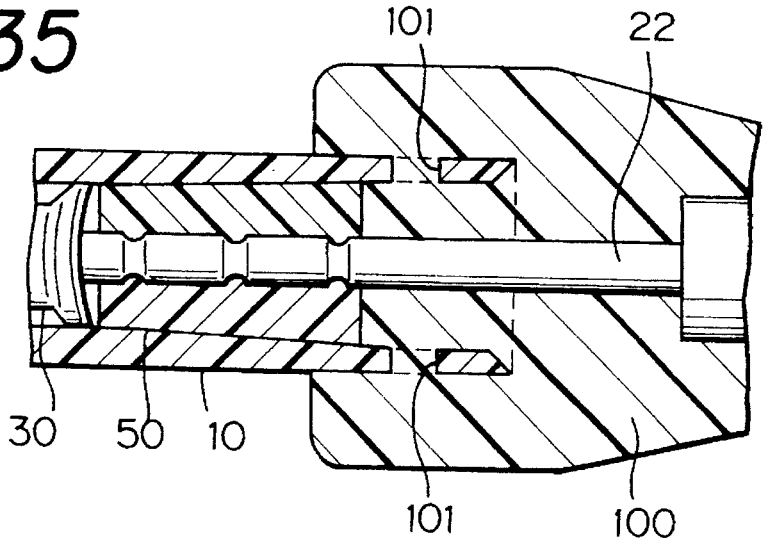
FIG. 35 is a partial longitudinal sectional view of still another connector housing in the second embodiment of the present invention.

FIG. 34 shows a fourteenth alteration in which the mold resin 100 is firmly attached to the connector housing 10. In this alteration, the connector housing 10 is provided on its rear end with a single annular rib 15 which is provided with a plurality of through holes 152 into which the mold resin enters. This assures that the mold resin layer is prevented from coming out of the connector housing 10. Two annular ribs each having a plurality of through holes may be provided on the rear end of the connector housing 10 although they are not shown in the drawing.

Figure 36:
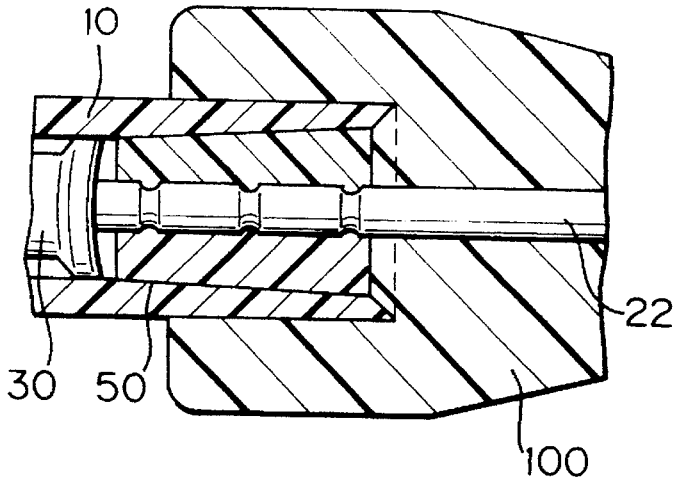
FIG. 36 is a partial longitudinal sectional view of still another connector housing in the second embodiment of the present invention.

The annular ribs 15 and 16 may not be provided in the connector housing 10. For example, in a fifteenth alteration shown in FIG. 35, the connector housing 10 may be provided in its rear end with a plurality of through holes 101 into which the mold resin enters, thereby preventing the mold resin layer 100 from coming out of the connector housing 10. If a small force is required to prevent the layer 100 from coming-out, a sixteenth alteration as shown in FIG. 36 may be provided with no annular ribs 15, 16 and through holes 101.

Figure 37:
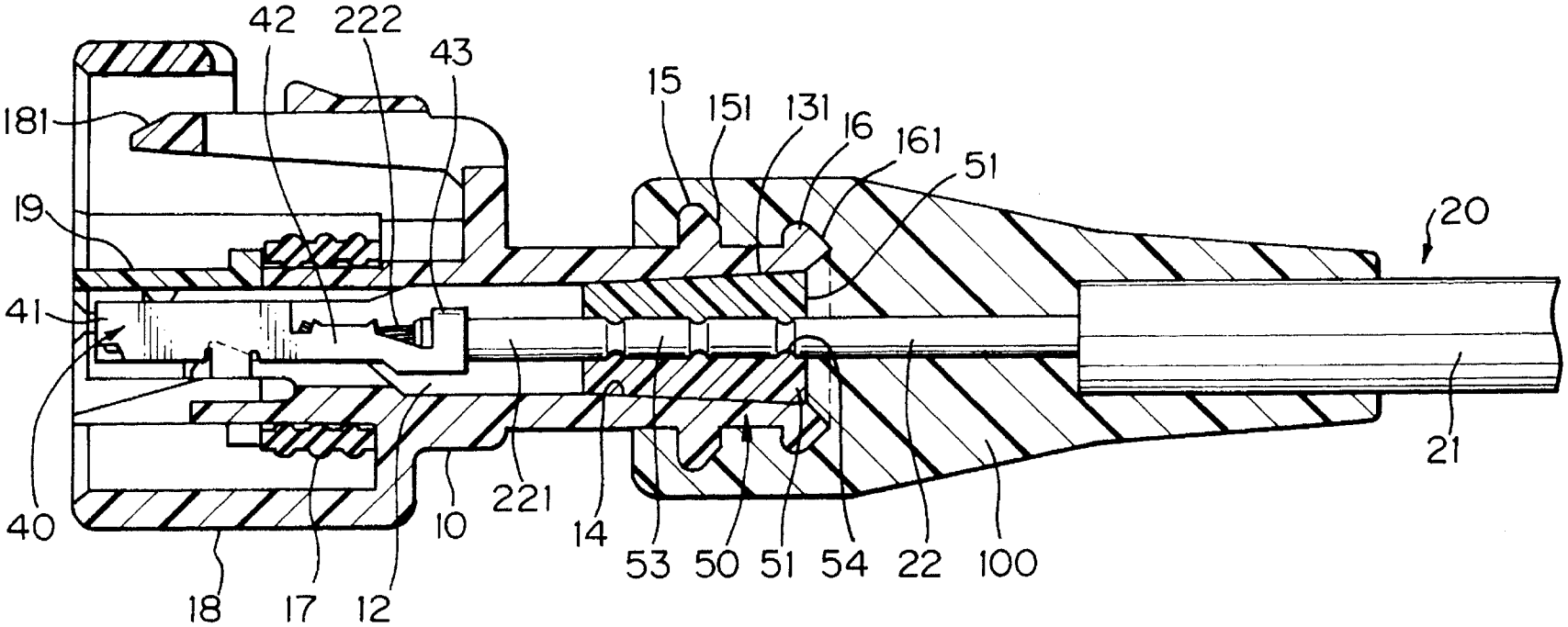
FIG. 37 is a longitudinal sectional view of still another modified example in the second embodiment of the present invention.

FIG. 37 shows a seventeenth alteration. A difference between the seventeenth alteration and the second embodiment is to omit the waterproofing seal 30. The other elements between them are the same and are indicated by the same signs to avoid a repetition of explanation.

It is possible to bring the plug body 50 into close contact with the interior of the chamber 14 by utilizing an injection pressure of the mold resin since the plug mold is tapered, thereby maintaining the waterproofing function at a high level.

Figure 38:
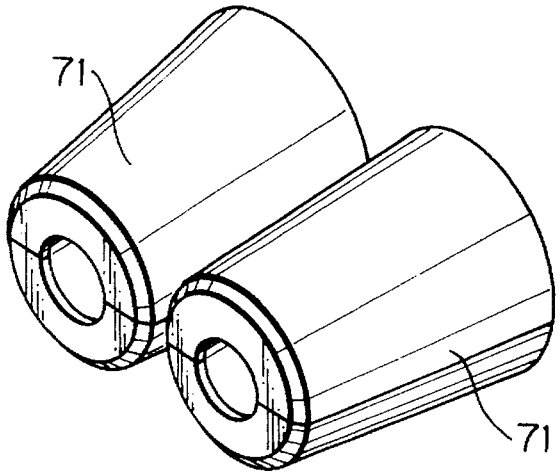
FIG. 38 is a perspective view of a still another divided plug body in the second embodiment of the present invention.
Figure 39:
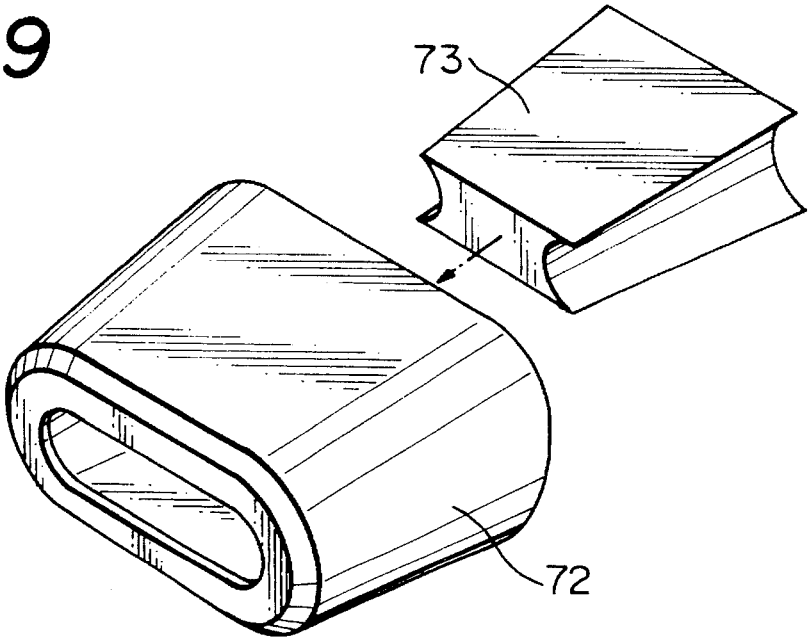
FIG. 39 is an exploded perspective view of still another divided plug body in the second embodiment of the present invention.
Figure 40:
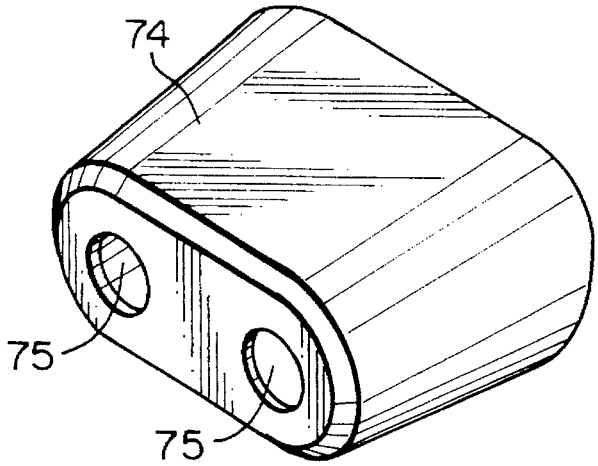
FIG. 40 is a perspective view of still another plug body in the second embodiment of the present invention.

FIG. 38 shows an eighteenth alteration having a plug body different from that of the second embodiment. The plug body includes two tapered cylindrical member 71, 71 which are divided into an upper half part and a lower half part. The taper of each member 71 is conformed to each cavity in the connector housing. A nineteenth alteration shown in FIG. 39 includes a tapered flat cylindrical member 72 and a partition member 73 to be inserted into the member 72 to define two through holes respectively for permitting the core wires to pass through. A twentieth alteration shown in FIG. 40 includes a single tapered plug body 74 with two wire through holes 75.

Figure 41:
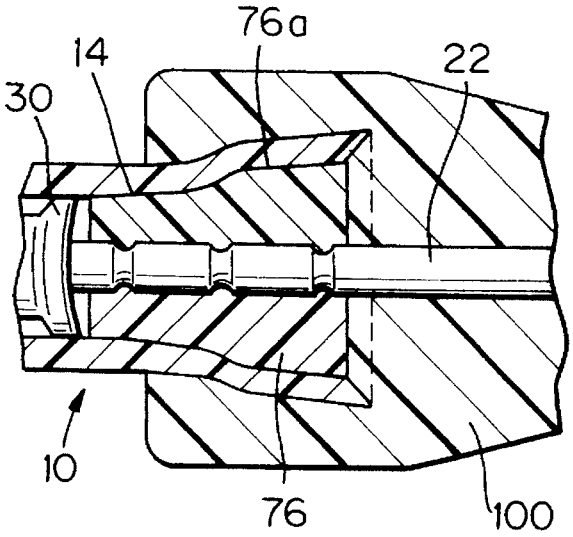
FIG. 41 is a partial longitudinal sectional view of still another connector housing in the second embodiment of the present invention.

FIG. 41 shows a twenty-first alteration which improves the connector housing and plug body in the second embodiment. The connector housing 10 has a stepped chamber 14. The plug body 76 has a stepped portion **76*a* which conforms to the stepped chamber 14. This structure can prevent the plug body 76 from entering too far into the chamber toward the cavities 12 upon insertion of the plug body 76** or injection of the mold resin.

Figure 42:
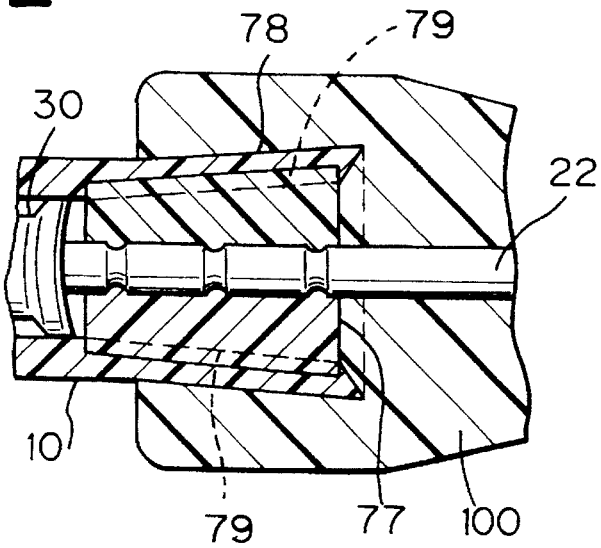
FIG. 42 is a partial longitudinal sectional view of still another connector housing in the second embodiment of the present invention.
Figure 43:
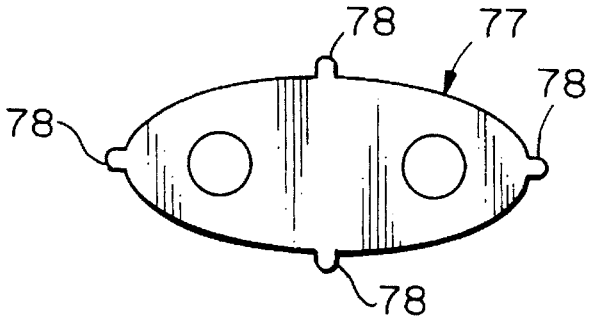
FIG. 43 is a front elevational view of the plug body shown in FIG. 42.

FIGS. 42 and 43 show a twenty-second alteration having a different improvement. A plug body 77 is provided on its exterior with guide ribs 78 extending in the inserting direction. The connector housing 10 is provided in its interior with two guide grooves 79 each of which receives each guide rib 78. This structure has advantages that the plug body 77 can be guided into the chamber 14 without causing any plays and can make firm contact with the chamber 14.

The present invention should not be limited to the above embodiments and alterations. For example, the plug body to which adhesive, expansive agent, seal agent or rubber layer is applied may be disposed in the plug body accommodating chamber.

Next, a third embodiment of a waterproofed connector in accordance with the present invention will be described below by referring to FIGS. 44 to 72. Since the same signs in the second embodiment shown in FIGS. 44 to 72 as those in the first and second embodiments shown in FIGS. 1 to 9 and 10 to 43 indicate the same elements or parts, respectively, explanations of such structure and arrangement will be omitted below.

Figure 44:
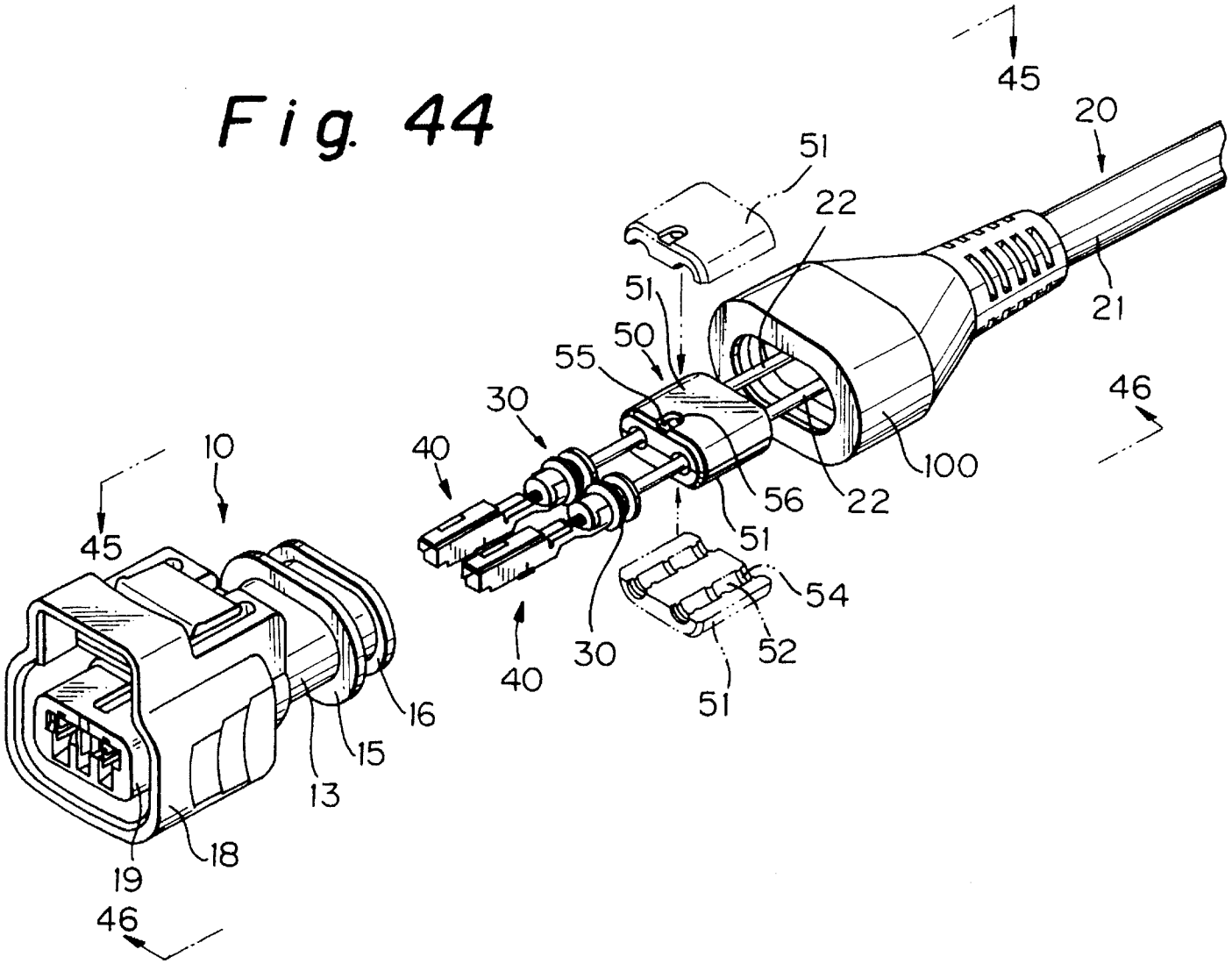
FIG. 44 is an exploded perspective view of a third embodiment of a waterproofed connector in accordance with the present invention.
Figure 45:
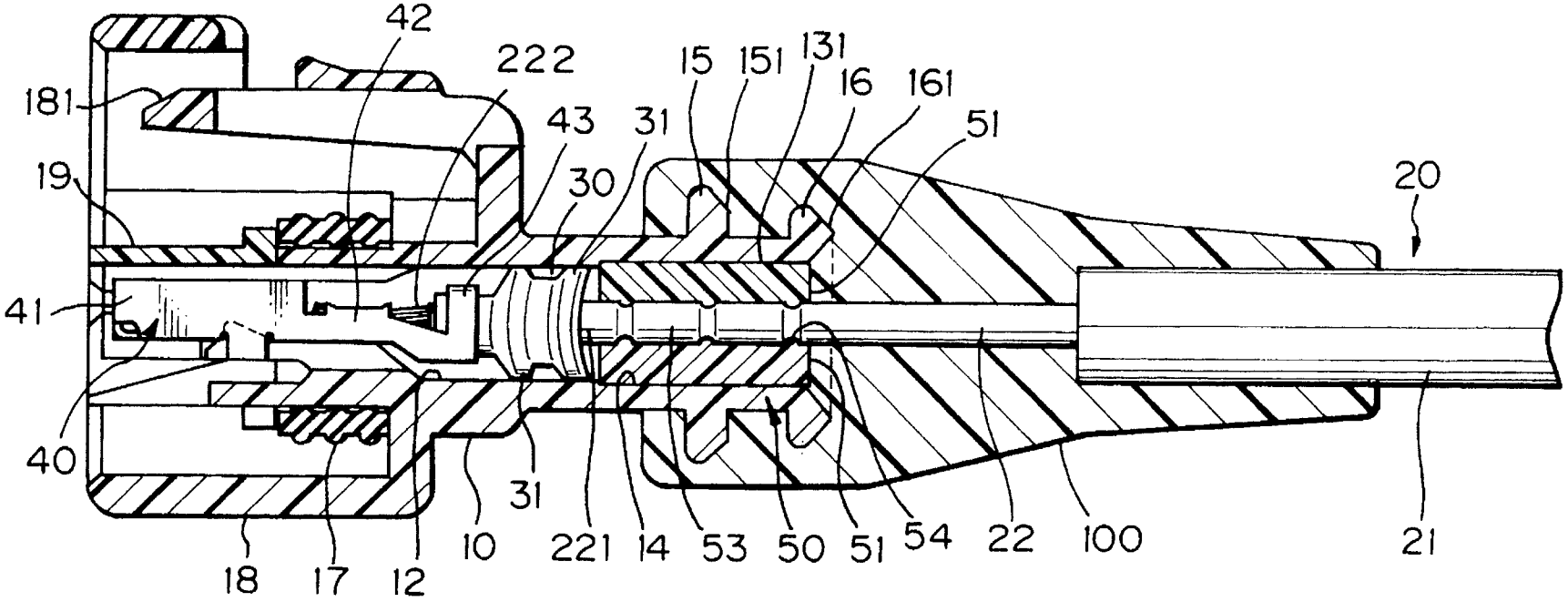
FIG. 45 is a longitudinal sectional view taken along line 45—45 in FIG. 44.
Figure 46:
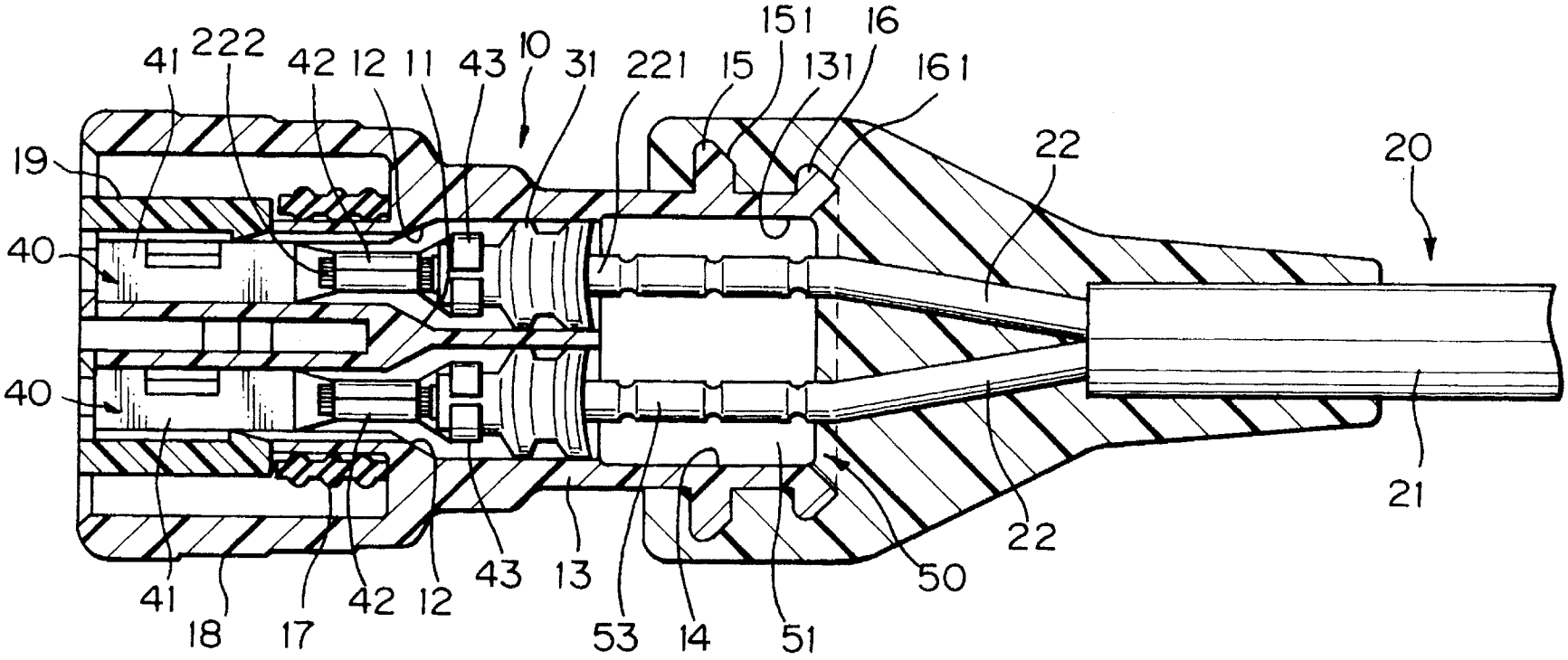
FIG. 46 is a longitudinal sectional view taken along line 46—46 in FIG. 44.

A plug body 50 made of a hard plastic material is disposed through the terminal insertion opening 131 in the plug body accommodating chamber 14 in the connector housing 10. As shown in FIG. 44, the plug body 50 is divided into a pair of upper and lower half parts 51 and 51 to clamp two core wires 22 between the parts 51. Each half part 51 is provided with two U-shaped grooves on the fitting face to be coupled to the mating half part. When the half parts 51, 51 are coupled to each other, the opposed grooves 52 define wire through holes 53 which permit the wires 22 to pass therethrough. In the third embodiment, the plug body 50 and the chamber 14 are not tapered.

Figure 47:
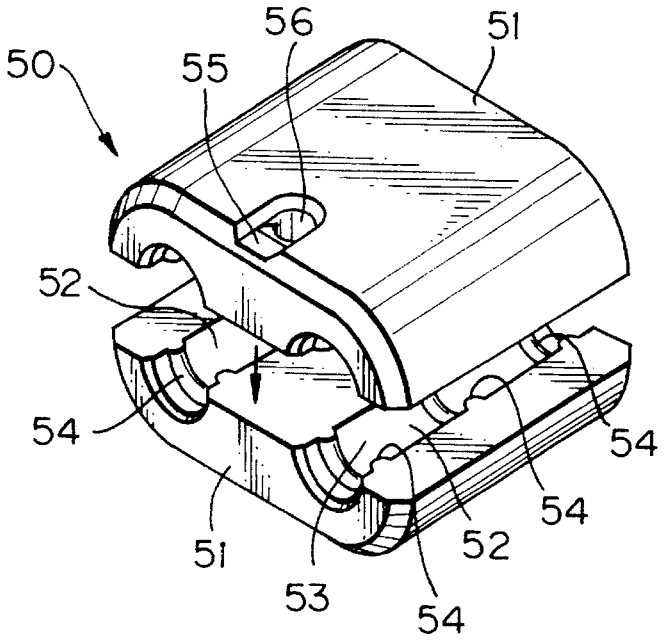
FIG. 47 is an exploded perspective view of a divided plug body in the third embodiment.

Three ridges 54 are formed peripherably and spaced axially on each groove 52 so that the ridges bite the insulation covers 221 of the core wires 22, thereby enhancing the sealing function between the front and rear ends in the plug body 50. As shown in FIG. 47, each half part 51 is provided in its upper end face with a recess 55 in which a receiving hole 56 is formed. A tool (not shown) can hook in the hole 56 to pull the part 51 out of the chamber 14.

Next, a process for producing the embodiment of the waterproofed connector in accordance with the present invention will be explained below.

Figure 48:
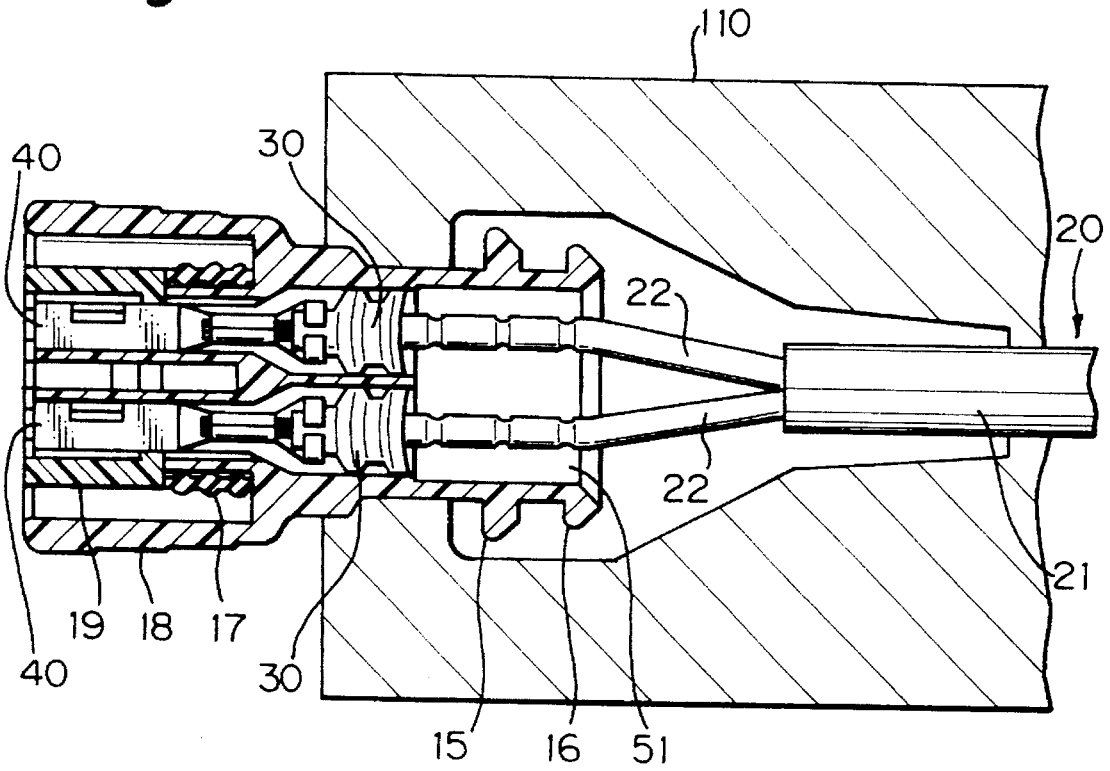
FIG. 48 is a longitudinal sectional view of the third embodiment, illustrating a process of forming a mold resin layer.
Figure 49:
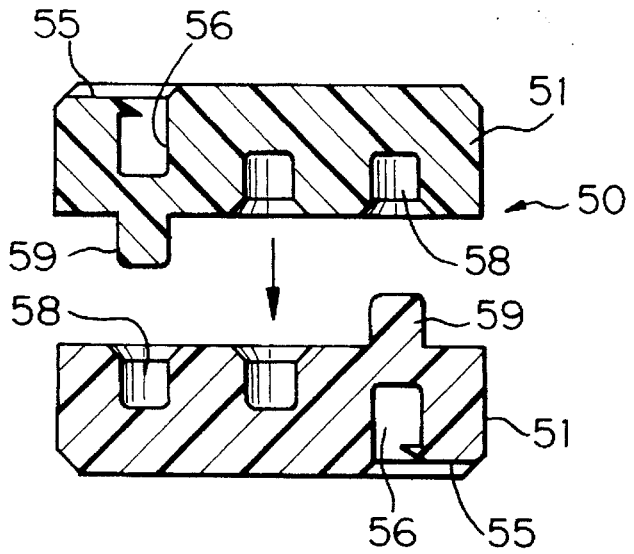
FIG. 49 is an exploded longitudinal sectional view of another divided plug body in the third embodiment of the present invention.
Figure 50:
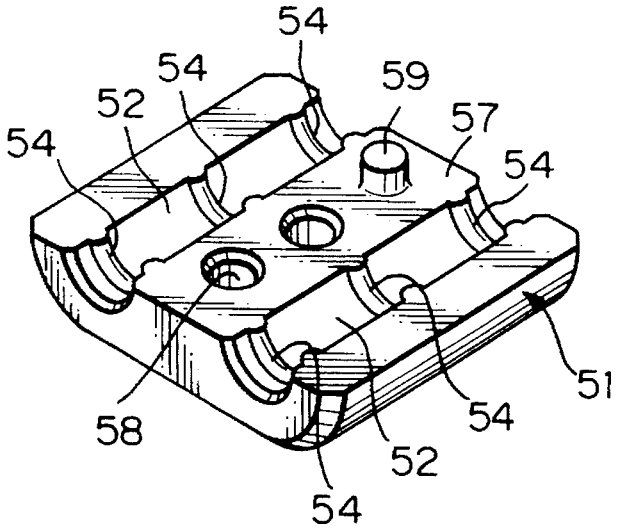
FIG. 50 is a perspective view of a half part of the divided plug body shown in FIG. 49.
Figure 51:
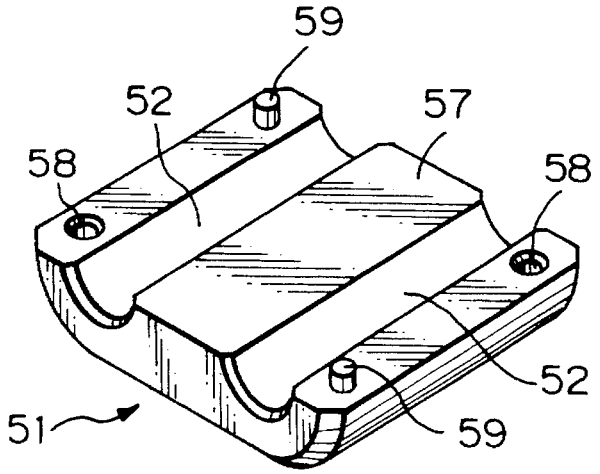
FIG. 51 is a perspective view of a half part of still another divided plug body in the third embodiment of the present invention.
Figure 52:
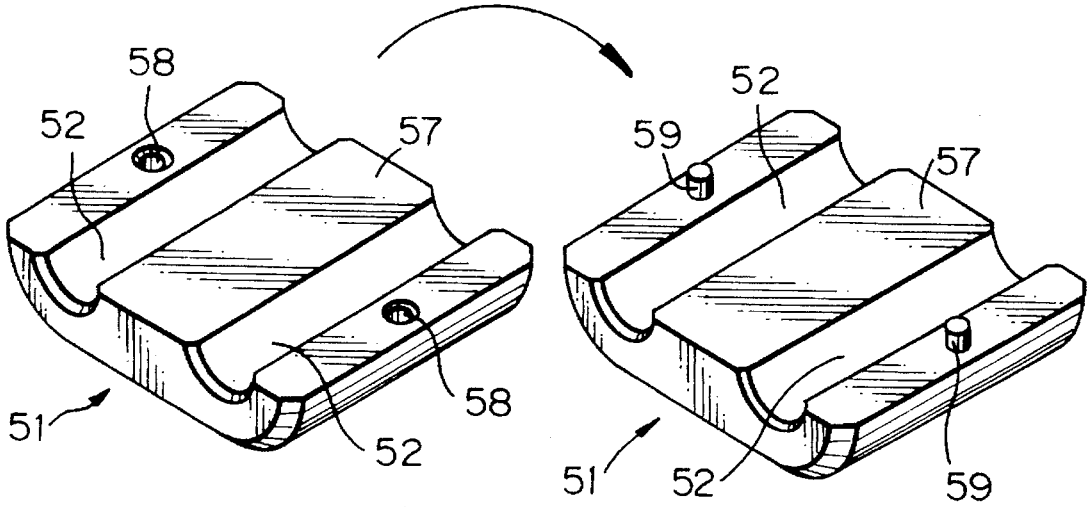
FIG. 52 is an exploded perspective view of still another divided plug body in the third embodiment of the present invention.
Figure 53:
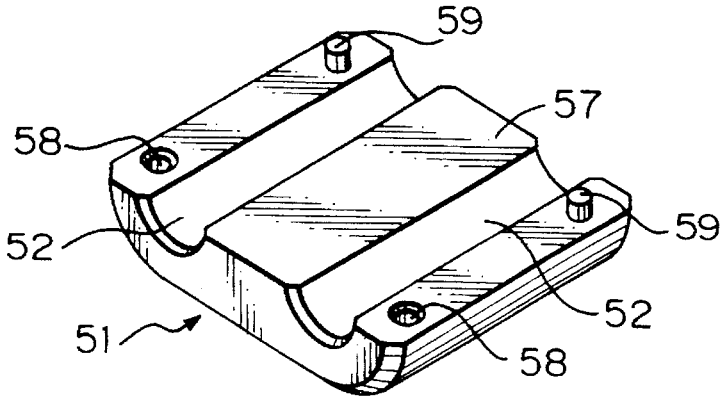
FIG. 53 is a perspective view of a half part of still another divided plug body in the third embodiment of the present invention.
Figure 54:
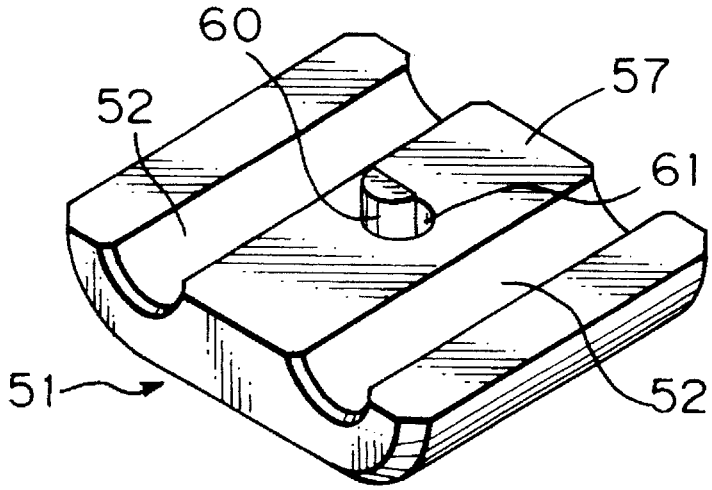
FIG. 54 is a perspective view of a half part of still another divided plug body in the third embodiment of the present invention.
Figure 55:
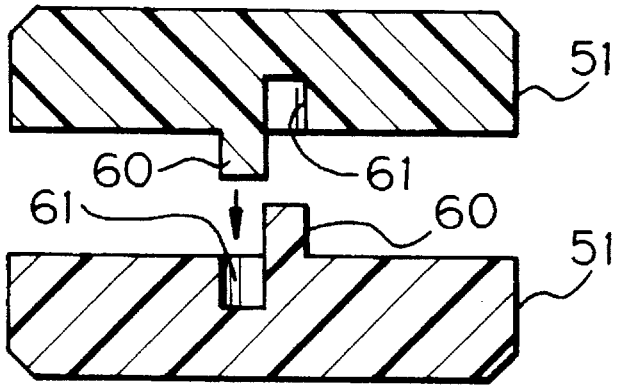
FIG. 55 is an exploded longitudinal sectional view of the divided plug body shown in FIG. 54.
Figure 56:
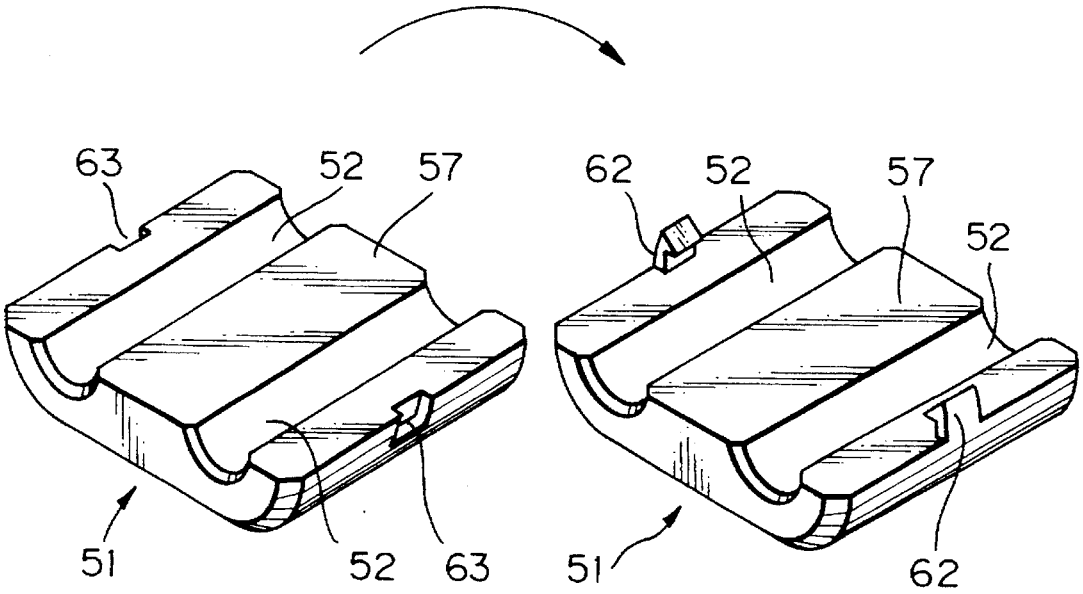
FIG. 56 is an exploded perspective view of still another divided plug body in the third embodiment of the present invention.
Figure 57:
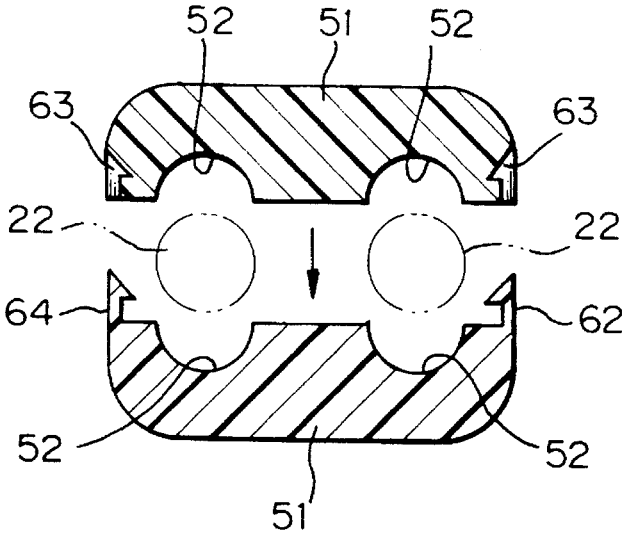
FIG. 57 is an exploded cross-sectional view of the divided plug body shown in FIG. 56.
Figure 58:
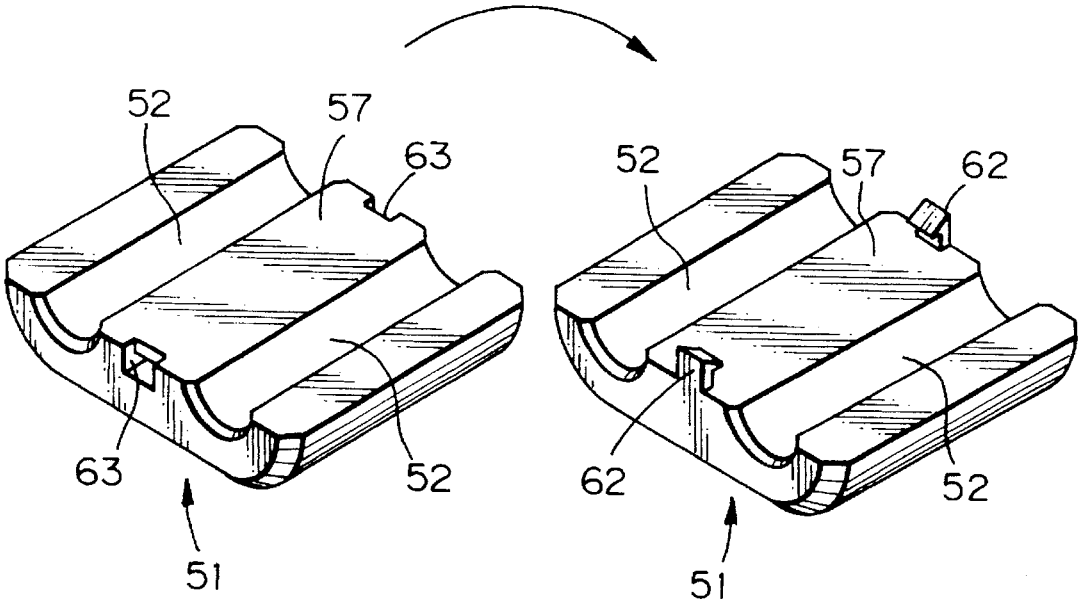
FIG. 58 is an exploded perspective view of still another divided plug body in the third embodiment of the present invention.
Figure 59:
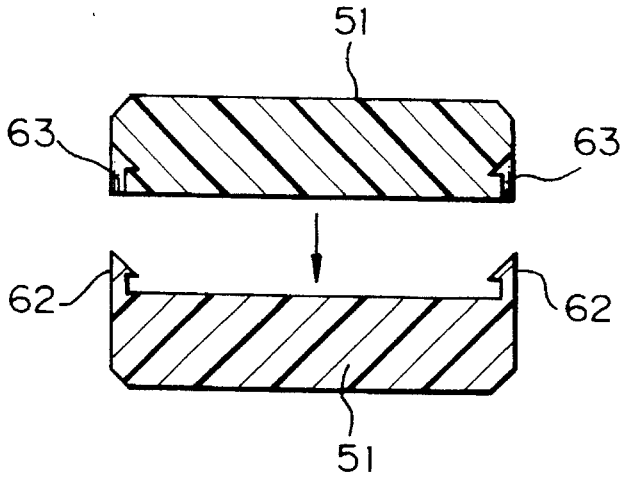
FIG. 59 is an exploded longitudinal sectional view of the divided plug body shown in FIG. 58.
Figure 60:
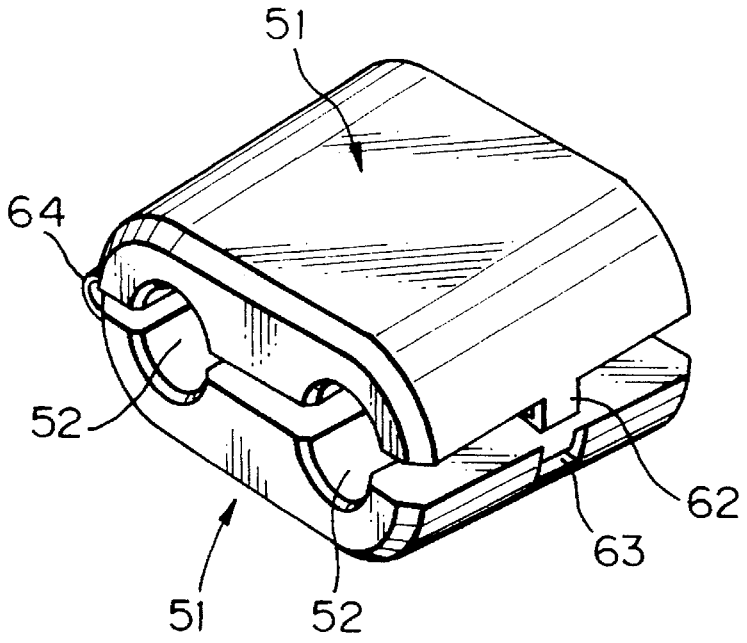
FIG. 60 is a perspective view of still another divided plug body in the third embodiment of the present invention.
Figure 61:
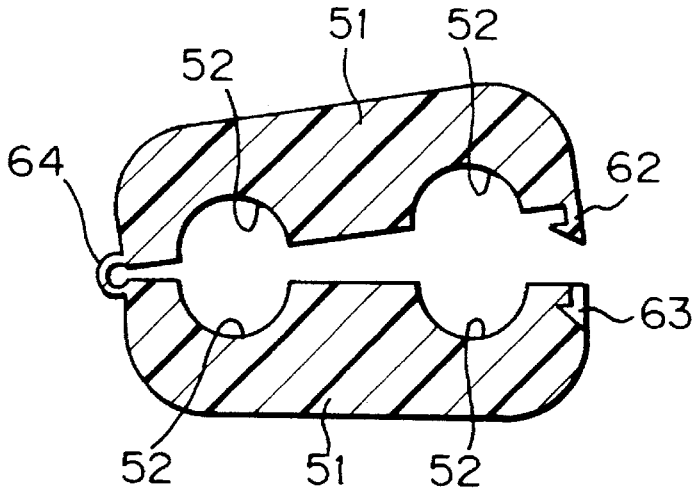
FIG. 61 is a cross-sectional view of the divided plug body shown in FIG. 60.
Figure 62:
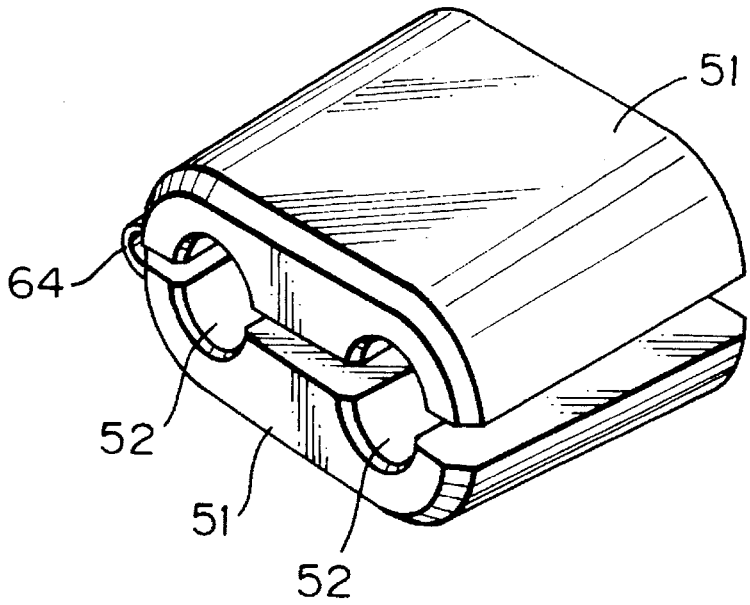
FIG. 62 is a perspective view of still another divided plug body in the third embodiment of the present invention.
Figure 63:
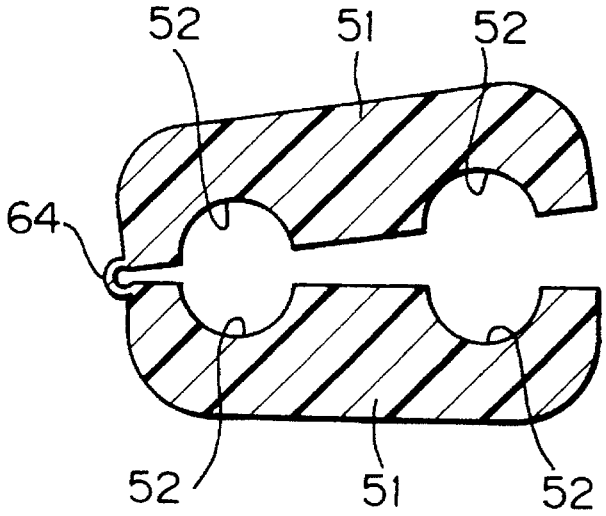
FIG. 63 is a cross-sectional view of the divided plug body shown in FIG. 62.
Figure 64:
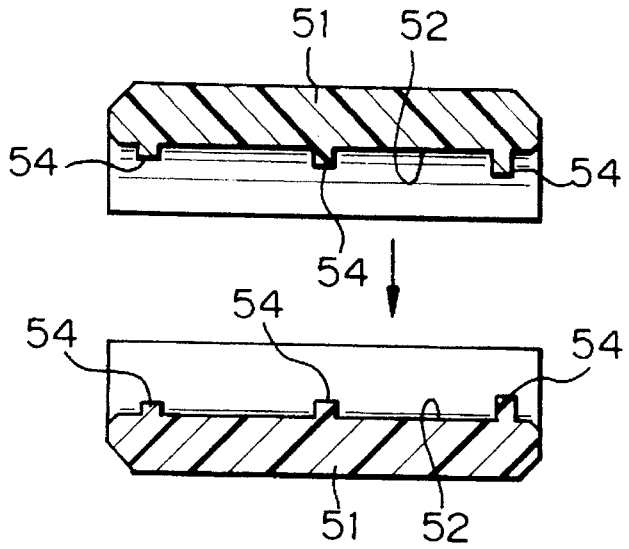
FIG. 64 is an exploded longitudinal sectional view of still another plug body in the third embodiment of the present invention.

The terminal metal fixture 40 is crimped on an end of each core wire 22 of the electrical cable 20 with the waterproofing seal 30 being attached to a section near the end. The terminal metal fixture 40 is inserted into each cavity 12 in the connector housing 10 and then the retainer 19 is pushed onto a locking position to prevent the terminal metal fixture 40 from coming out of the cavity 12. Then, one of the half parts 51, 51 is inserted into the plug body accommodating chamber 14 through the terminal insertion opening 131 in the connector housing 10 while the half part 51 is in contact with the underside of the core wires 22. The other half part 51 is inserted into the chamber 14 through the opening 131 while the part 51 is in contact with the upside of the core wires 22. Two half parts 51, 51 clamp the core wires 22, 22, so that the core wires 22, 22 pass through the holes 53, 53 in the plug body 50, respectively. Upon inserting two half parts 51, if they are strongly pushed into the chamber 14, the ridges 54 on the grooves 52 in each half part 51 bite the insulation cover 221 of the core wires 22. Consequently, the plug body 50 is compressed in the chamber 14 in the connector housing 10 while the plug body 50 firmly clamps the core wires 22. The connector housing 10 under the present state is set in the mold 110 as shown in FIG. 48, the mold resin is injected in the mold 110, and the molded product is removed from the mold 110 by opening the mold 110 after cooling. Thus, the waterproofed connector having the mold resin layer 100 on the rear end of the connector housing 10 is obtained.

The effects of the third embodiment are as follows in addition to the effects of the first embodiment.

The mold resin layer 100 enclosing the cable inlet for the electrical cable 20 in the connector housing 10 can effectively prevent the water from entering through the cable inlet into the connector housing 10.

Minute gaps may be generated between the mold resin layer 100 and the connector housing 10 or the core wires 22 after molding. Since the present embodiment provides the mold resin layer 100 around the rear end of the connector housing 10 and the waterproofing seal 30 in the terminal insertion opening 131 of the cavities 12, the waterproofing seal 30 can prevent the water from entering the cavities 12 toward the terminal metal fixtures 40 even if water enters the opening 131 through the gaps between the mold resin layer 100 and the core wires 22 or the connector housing 10.

Accordingly, it is possible to freely select various kinds of material for the connector housing 10, core wires 22, mold resin layer, or the like in view of the cost and the like without considering the gap. This embodiment can reconcile a low cost and a high level of waterproofing.

The resilient mold resin layer 100 formed on the cable inlet for the electrical cable 20 can follow any bend in the cable 20 to maintain the waterproofing function. The resilient mold resin layer 100 is not broken by any hit of stones or the like when a moving vehicle spatters the stones or the like, thereby enhancing a reliability of the connector.

In this embodiment, since the plug body 50, through which the core wires 22 pass, is disposed in the terminal insertion opening 131, the mold resin layer 100 can prevent the mold resin from flowing forcibly into the cavities 12 toward the waterproofing seal 30 upon molding. The mold resin pushes the plug body 50 toward the waterproofing seal 30, thereby preventing the mold resin from leaking into the cavities toward the terminal metal fixture 40. It is also possible to raise the injection pressure of the mold resin. Even if the electrical cable 20 or the core wires 22 are subjected to any bending force, the plug body 50 maintains the core wires 22 at the center in the terminal insertion opening 131 so that the bending force is not transmitted to the waterproofing seal 30, thereby enhancing the waterproofing function of the seal 30.

The present invention should not be limited to the above embodiment. For example, the following alterations should be included in the present invention. In order to avoid a repetition of explanation, the same elements or parts in each of the above alterations as those in the first embodiment are indicated by the same signs in the drawings and only different elements or parts will be described below. Each alteration (FIGS. 49 to 72) in the third embodiment substantially corresponds to each alteration (FIGS. 15 to 36) in the second embodiment. In the difference between both alterations, the plug body 50 in the alterations in the second embodiment is tapered while the plug body 50 in the alterations in the third embodiment is not tapered. The plug body 50 in the third embodiment has no directivity since the plug body 50 is not tapered.

Figure 65:
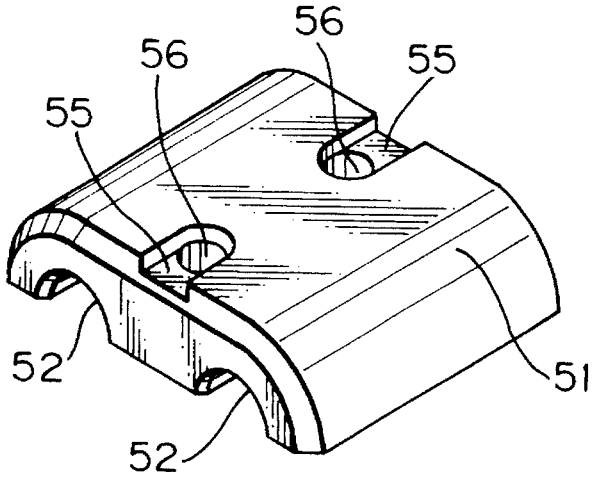
FIG. 65 is a perspective view of a half part of still another divided plug body in the third embodiment of the present invention.
Figure 66:
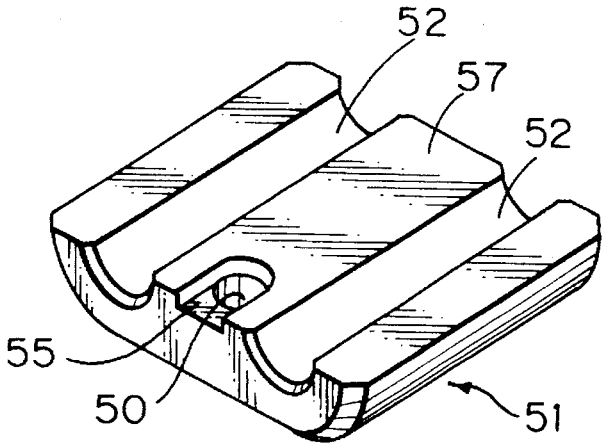
FIG. 66 is a perspective view of a half part of still another divided plug body in the third embodiment of the present invention.

FIG. 65 shows an alteration in which the plug body arranged in the chamber 14 is readily removed.

Figure 67:
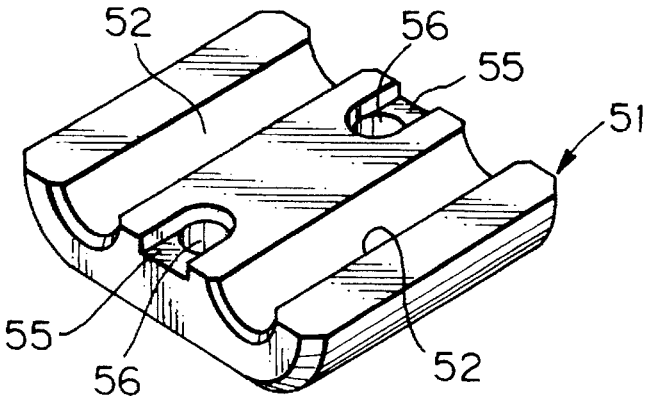
FIG. 67 is a perspective view of a half part of still another divided plug body in the third embodiment of the present invention.
Figure 68:
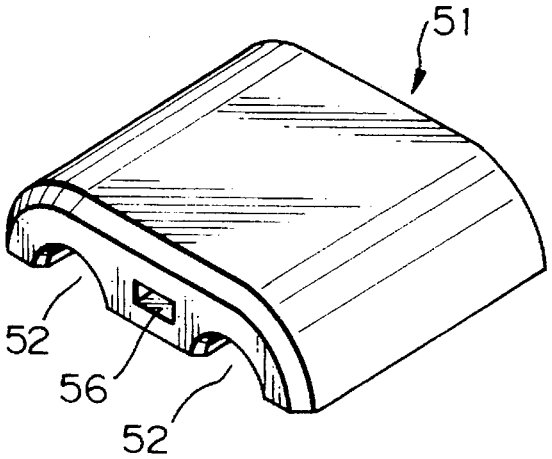
FIG. 68 is a perspective view of a half part of still another divided plug body in the third embodiment of the present invention.
Figure 69:
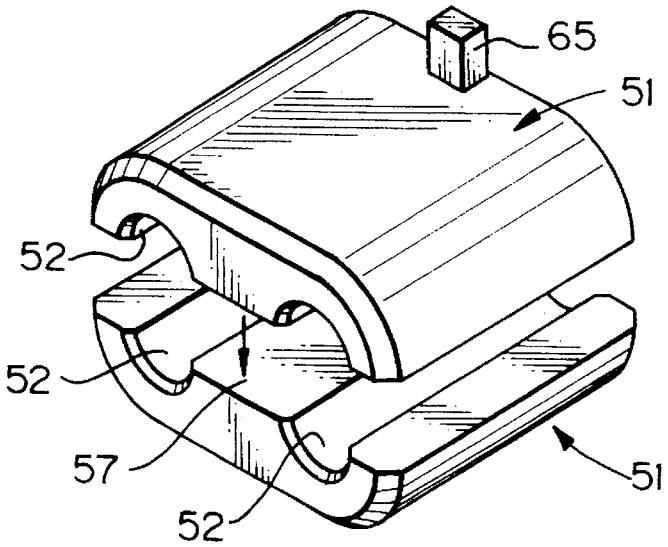
FIG. 69 is an exploded perspective view of still another divided plug body in the third embodiment of the present invention.
Figure 70:
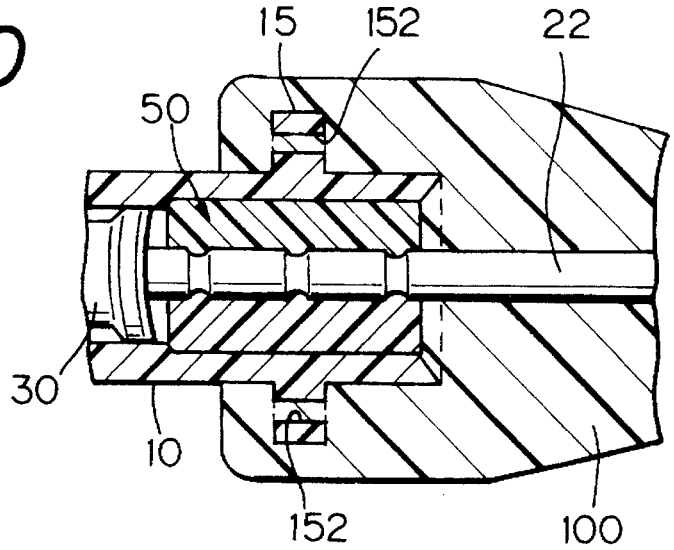
FIG. 70 is a partial longitudinal sectional view of another connector housing in the third embodiment of the present invention.
Figure 71:
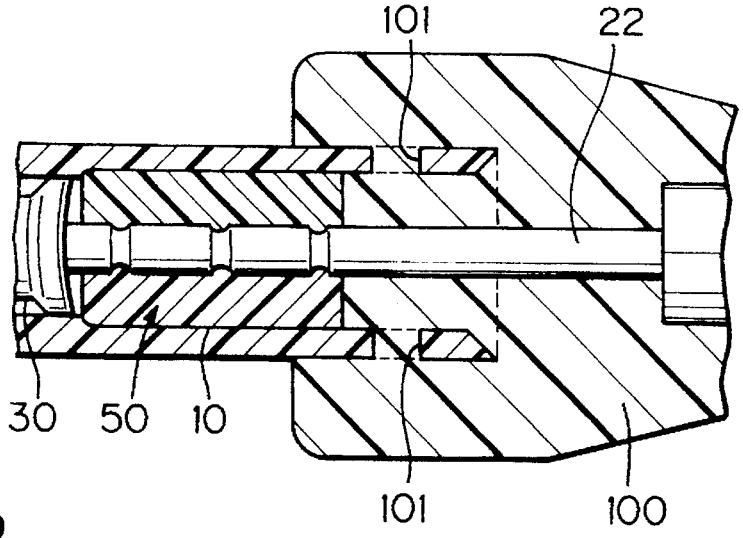
FIG. 71 is a partial longitudinal sectional view of still another connector housing in the third embodiment of the present invention.
Figure 72:
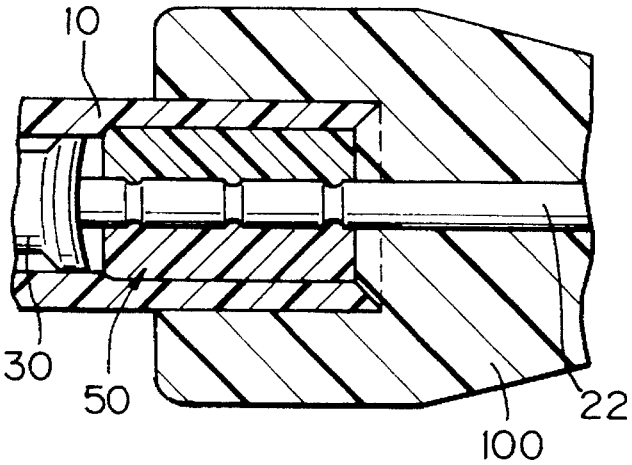
FIG. 72 is a partial longitudinal sectional view of still another connector housing in the third embodiment of the present invention.

The half part 51 is provided in its top faces of the front and rear ends with recesses 55 in which engaging holes 56 are formed to be hooked by a tool (not shown) when the half part 51 must be pulled out of the chamber 14. The holes 56 in the recesses 55 in the opposite ends of the half part 51 can be disposed in the chamber 14 in the connector housing 10 without taking care of the directivity of the plug body 50. As shown in FIG. 67, the recesses 55 and engaging holes 56 may be provided in the inner face of the front and rear ends of the half part 51.

There is no difference between the other elements in both embodiments.

What is claimed is:

1. A waterproofed connector comprising:

a connector housing having a cavity provided with a terminal insertion opening;

terminal metal fixtures each of which is connected to an end of each core wire of an electrical cable and inserted into said cavity through said terminal insertion opening;

a plug body having through holes each of which permits said core wire to pass through and enter into said cavity through said terminal insertion opening; and a molded resin layer enclosing a rear end of said connector housing and an end of said electrical cable with said terminal metal fixtures and plug body being accommodated in said cavity in said connector housing, said plug body being provided with a slit extending from the exterior to said each through hole.

2. A waterproofed connector according to claim 1, wherein said plug body is made of a resilient material.

3. A waterproofed connector according to claim 1, wherein a rear end of said connector housing embedded in said mold resin layer is provided with a plurality of through holes for enhancing a connection between said housing and said layer.

4. A waterproofed connector comprising:

a connector housing having a cavity provided with a terminal insertion opening;

terminal metal fixtures each of which is connected to an end of each core wire of an electrical cable and inserted into said cavity through said terminal insertion opening;

a plug body having through holes each of which permits said core wire to pass through and enter into said cavity through said terminal insertion opening; and a molded resin layer enclosing a rear end of said connector housing and an end of said electrical cable with said terminal metal fixtures and plug body being accommodated in said cavity in said connector housing, said plug body being provided on a front end face with a plurality of vertical ridges, on a rear end with a flange, and on a middle portion with a barrel-like bulged portion.

5. A waterproofed connector comprising:

a connector housing having a cavity provided with a terminal insertion opening;

terminal metal fixtures each of which is connected to an end of each core wire of an electrical cable and inserted into said cavity through said terminal insertion opening;

a plug body having through holes each of which permits said core wire to pass through and enter into said cavity through said terminal insertion opening; and a molded resin layer enclosing a rear end of said connector housing and an end of said electrical cable with said terminal metal fixtures and plug body being accommodated in said cavity in said connector housing, wherein said plug body is made of hard plastic material, and wherein the exterior of said plug body and the interior of an accommodating chamber for said plug body in said cavity are tapered so that the exterior and interior firmly contact each other.

6. A waterproofed connector according to claim 5, wherein said plug body is divided into a pair of half parts, and wherein said divided plug body is inserted into said accommodating chamber in said cavity through said terminal insertion opening with said half parts clamping said core wires.

7. A waterproofed connector according to claim 6, wherein said divided plug body includes an upper half part and a lower half part, and wherein said upper and lower half parts are interconnected by a hinge.

8. A waterproofed connector according to claim 6, wherein said half parts of said divided plug body are provided with temporary locking portions for coupling with each other.

9. A waterproofed connector according to claim 8, wherein said temporary locking portions include an engaging hole and an engaging projection.

10. A waterproofed connector according to claim 8, wherein said temporary locking portions include an engaging recess and an engaging pawl.

11. A waterproofed connector according to claim 8, wherein a rear end of said connector housing embedded in said mold resin layer is provided with a plurality of through holes for enhancing a connection between said housing and said layer.

12. A waterproofed connector according to claim 6, further comprising a waterproofing seal inserted into an inner part of said cavity through said terminal insertion opening to make close contact with an interior of said inner part of said cavity.

13. A waterproofed connector comprising:

a connector housing having a cavity provided with a terminal insertion opening;

terminal metal fixtures each of which is connected to an end of each core wire of an electrical cable and inserted into said cavity through said terminal insertion opening;

a plug body having through holes each of which permits said core wire to pass through, inserted into said cavity through said terminal insertion opening, said plug body being made of a hard plastic material and formed into a rectangular configuration divided into upper and lower half parts;

a waterproofing seal inserted into an inner part of said cavity through said terminal insertion opening to firmly contact an interior of said inner part of said cavity; and a mold resin layer enclosing a rear end of said connector housing and an end of said electrical cable said terminal metal fixtures and plug body being accommodated in said cavity in said connector housing.

14. A waterproofed connector according to claim 13, wherein said upper and lower half parts are interconnected by a hinge.

15. A waterproofed connector according to claim 13, wherein said half parts of said divided plug body are provided with temporary locking portions for coupling with each other.

16. A waterproofed connector according to claim 15, wherein said temporary locking portions include an engaging hole and an engaging projection.

17. A waterproofed connector according to claim 15, wherein said temporary locking portions include an engaging recess and an engaging pawl.

18. A waterproofed connector according to claim 13, wherein a rear end of said connector housing embedded in said mold resin layer is provided with a plurality of through holes for enhancing a connection between said housing and said layer.

* * * * *